US009498797B2

(12) United States Patent
Guenther et al.

(10) Patent No.: US 9,498,797 B2
(45) Date of Patent: Nov. 22, 2016

(54) COMPACT SORTING DEVICE FOR SORTING A MATERIAL MIXTURE

(71) Applicant: Guenther Holding Gmbh & Co. KG

(72) Inventors: Bernhard Guenther, Wartenberg (DE); Matthias Sternstein, Wartenberg (DE); Markus Wess, Eichenzell-Kerzell (DE)

(73) Assignee: GUENTHER HOLDING GMBH & CO. KG, Wartenberg (DE)

( * ) Notice: Subject to any disclaimer, the term of this patent is extended or adjusted under 35 U.S.C. 154(b) by 0 days.

(21) Appl. No.: 14/681,328

(22) Filed: Apr. 8, 2015

(65) Prior Publication Data

US 2015/0306633 A1 Oct. 29, 2015

(30) Foreign Application Priority Data

Apr. 9, 2014 (DE) ..... 20 2014 101 687 U

(51) Int. Cl.

| | |
|---|---|
| ***B07C 5/12*** | (2006.01) |
| ***B07B 13/16*** | (2006.01) |
| ***B07B 1/00*** | (2006.01) |
| ***B07B 1/15*** | (2006.01) |
| ***B03C 1/30*** | (2006.01) |
| ***B07B 1/14*** | (2006.01) |
| ***B07B 15/00*** | (2006.01) |

(52) U.S. Cl.

CPC ..... *B07B 13/16* (2013.01); *B03C 1/30* (2013.01); *B07B 1/005* (2013.01); *B07B 1/14* (2013.01); *B07B 1/15* (2013.01); *B07B 15/00* (2013.01)

(58) Field of Classification Search

CPC ..... B07B 13/16; B07B 1/005; B07B 1/14; B07B 1/15; B07B 15/00; B03C 1/30

USPC ..... 209/667

See application file for complete search history.

(56) References Cited

U.S. PATENT DOCUMENTS

| | | | | |
|---|---|---|---|---|
| 5,819,950 | A * | 10/1998 | McCloskey | B07B 1/005 198/313 |
| 6,382,425 | B1 * | 5/2002 | Brickner | B07B 1/005 209/12.1 |
| 6,626,608 | B2 * | 9/2003 | Olynyk | B02C 21/026 241/101.763 |
| 7,721,983 | B2 * | 5/2010 | Kitaguchi | B02C 13/286 241/186.35 |
| 8,544,783 | B2 * | 10/2013 | Cotter | B02C 13/286 241/186.3 |

FOREIGN PATENT DOCUMENTS

| | | | | |
|---|---|---|---|---|
| DE | 3734360 | A1 * | 4/1988 | B07B 1/15 |
| EP | 1088599 | A1 | 4/2001 | |
| EP | 1570919 | A1 | 9/2005 | |

* cited by examiner

*Primary Examiner* — Terrell Matthews
(74) *Attorney, Agent, or Firm* — Panitch Schwarze Belisario & Nadel LLP

(57) ABSTRACT

A sorting device that can be transported by road or rail has rotary driven sorting rollers, supported on a frame, that together form a roller screen for sorting a material mixture into a fine grain size which falls through the roller screen and an oversize grain that is conveyed by the sorting rollers over a side edge of the roller screen. An oversize grain conveyor and collector is arranged below the sorting rollers. A channelling means extends along the side edge and is inclined in an operating position towards the oversize grain conveyor and collector, at least in sections, between an upper region, which faces the side edge at a distance, and a lower region which is near the oversize grain conveyor and collector, in order to channel oversize grain, which is conveyed over the side edge of the roller screen, downwards to the oversize grain conveyor and collector.

24 Claims, 10 Drawing Sheets

COMPACT SORTING DEVICE FOR SORTING A MATERIAL MIXTURE

BACKGROUND OF THE INVENTION

The invention relates to a sorting device for sorting a mixture of materials, also referred to in the following as a material mixture, into fractions of different grain. The sorting device can then in particular be disposed to sort the material mixture according to grain size or another geometric grain characteristic or according to grain weight or another physical characteristic. The sorting device can also be disposed to sort according to different geometric or physical characteristics, for example grain size and a physical characteristic such as for example grain weight and/or an electrical and/or magnetic characteristic. Preferably, the sorting device is disposed to sort according to grain size. Preferred applications include separating different fractions from material mixtures such as for example excavated earth, quarry waste, earth-stone mixtures in general, organic waste, bulky waste of any kind, electrical waste, scrap metal from recycling cars, household and commercial refuse, waste wood and so on.

In order to sort and separate material fractions from material mixtures of the kind mentioned, correspondingly large-volume, stable sorting devices are required. Sorting by means of a roller screen, which comprises a number of rotary-driven rollers arranged alongside each other, has proven effective. The material mixture which is conveyed onto the roller screen is sorted and/or separated by the roller screen into at least two grain fractions, namely one fraction of coarser grain—the oversize grain—which is conveyed on the roller screen to a side edge of the roller screen, and a comparatively finer undersize grain and/or fine grain which falls through the roller screen. The fractions which are separated from each other in this way, i.e. the fine grain and the oversize grain, are discharged and transported away or are additionally sorted in one or more downstream sorting stages of the sorting device.

Roller screens consisting of disc rollers, star rollers or in particular spiral rollers, which may also be referred to as helical rollers, are known. Roller screens of this kind which have proven effective in practice are disclosed in EP 1 570 919 B1 and EP 1 088 599 B1.

Sorting devices for material mixtures of the kind mentioned are typically stationary systems, not least because of their size, which are operated at the same site for years and embodied in accordance with the local available space. If, however, the material flows to be treated are encountered only once or periodically or at different times at different sites of the same operator, or if there is only limited on-site space available for setting up the sorting device, then a desire arises for a compact design or for mobility or even for renting the sorting device just for periods of time.

It is therefore an object of the invention to provide a sorting device of the kind described which enables a material mixture to be sorted into at least two different material fractions at a high material throughput and which is embodied in a compact design. The sorting device should be sufficiently compact in its design that it can be transported as a whole, in one unit, by road or rail, wherein this includes embodiments as a sorting device which can be driven by itself or towed or transported on a platform.

SUMMARY OF THE INVENTION

The invention is based on a sorting device for sorting a material mixture into fractions of different grain, said device comprising a frame and sorting rollers which are supported on the frame and can be rotary-driven. The sorting rollers are arranged alongside each other such that together they form a roller screen for sorting the material mixture. The roller screen is disposed to sort the introduced material mixture into at least two different material fractions, wherein sorting also involves separating the at least two fractions into a fine grain fraction and an oversize grain fraction, which are referred to in the following as fine grain and oversize grain. When the sorting rollers are rotary-driven, the oversize grain is conveyed by the sorting rollers in a roller conveying direction up to and over a side edge of the roller screen, while the fine grain falls downwards through gaps which remain between the sorting rollers. The sorting device also comprises an oversize grain conveyor for removing the oversize grain which is conveyed over the side edge of the roller screen.

In accordance with the invention, the oversize grain conveyor is on the one hand arranged below the sorting rollers, and on the other hand, the sorting device comprises a channelling means, which extends along the side edge of the roller screen, for the oversize grain which is conveyed over the side edge. The channelling means comprises an upper region and a lower region and is inclined in an operating position towards the oversize grain conveyor, at least in sections, between the upper region, which faces the side edge at a distance in the operating position, and the lower region which is near the oversize grain conveyor, in order to channel oversize grain, which is conveyed over the side edge of the roller screen in the roller conveying direction, downwards to the oversize grain conveyor. It is possible, because of the channelling means, to arrange the oversize grain conveyor below the roller screen, which saves space as viewed in a plan view onto the sorting device. In preferred embodiments, the oversize grain conveyor extends below the roller screen in the roller conveying direction up to at most said side edge as viewed in the plan view; expediently, it is slightly short of the side edge as viewed in the plan view. In principle, however, the possibility should not be excluded that the oversize grain conveyor protrudes very slightly beyond the side edge as viewed in the plan view, i.e. protrudes laterally beyond the roller screen. In such embodiments, however, the oversize grain conveyor is nonetheless arranged below the roller screen over at least a majority of its width as measured in the roller conveying direction.

The invention thus enables the dimensions of the sorting device, as measured in the roller conveying direction, to be reduced to a degree which would allow the sorting device to be transported as a whole, in one unit, on public roads and/or by rail. The sorting device is sufficiently compact in terms of its external dimensions, i.e. its overall length, width and height, that it can be driven or transported as a whole, in one unit, by road or rail.

The channelling means can be unable to be moved relative to the roller screen and can constantly assume its operating position in such embodiments. In order to be able to decrease the dimensions of the sorting device parallel to said roller conveying direction or, in the reverse scenario with the dimensions remaining the same, in order to be able to increase the extent of the roller screen as measured in the roller conveying direction, the channelling means is arranged in more preferred embodiments on the frame such that it can be moved back and forth relative to the roller screen between the operating position and a resting position which simultaneously also represents a transport position. The channelling means can be arranged such that it can be moved translationally and/or rotationally back and forth between the operating position and the resting position. It can preferably be rotated and even more preferably pivoted. In simple embodiments, which not least for this reason are advantageous embodiments, the channelling means is formed as a wall. If it can be pivoted, then it can correspondingly form a simple hinged wall. Its ability to pivot can however also be superimposed with an ability to move translationally, for example such that the channelling means can be pivoted out of the transport position and is raised or lowered at the same time as it is pivoted, so as to place the lower region of the channelling means on or laterally against the oversize grain conveyor or also in order for it to merely approach the oversize grain conveyor without making contact with it.

Advantageous embodiments include those in which the lower region of the channelling means, which faces the oversize grain conveyor, comprises a flexible strip which constantly lies on or against the oversize grain conveyor and so laterally limits the oversize grain conveyor in a particularly effective way and prevents the oversize grain which is to be removed from falling down laterally.

In preferred embodiments, an external side wall of the sorting device forms the channelling means. If the channelling means simultaneously forms a lateral external wall of the sorting device, the extent of the roller screen as measured in the roller conveying direction can be increased up to a maximum which is defined by the criterion of transportability. Combining the two functions, i.e. those of the channelling means and the external wall, also helps to reduce parts and thus reduce weight and cost.

In preferred embodiments, the sorting device can be easily transferred from an operational mode to a transport mode and from the transport mode back to the operational mode, once it has been taken to the site of operations, and is in this sense a mobile unit. It preferably comprises actuating members and a machine controller for automatically switching between the two modes. The sorting device then expediently comprises one or more discharge components for discharging at least one grain fraction or preferably a number of different grain fractions, wherein the one or more discharge means can (each) be moved back and forth between a retracted and an extended mode and can preferably be switched automatically. The one or more discharge means can thus (each) be able to be folded in and out and/or translationally retracted and extended. In particular in its transport mode, in which the preferably movable channelling means assumes its resting position and the one or more optional discharge means is or are each retracted, the sorting device can exhibit overall measured external dimensions which would allow it to be transported on a flatbed truck or railway carriage. Its external dimensions can correspond at least substantially to the external dimensions of an ISO container according to ISO standard 668. The external dimensions of the sorting device can also be such that the sorting device can be transported in one unit in an ISO container.

In preferred embodiments, the channelling means channels the oversize grain, which is conveyed over the side edge, towards the oversize grain conveyor only passively; gravity ensures that it is conveyed towards the oversize grain conveyor. The channelling means can in particular be a simple wall structure—simple in the sense that it does not comprise any movable, let alone motorised components in order to convey the oversize grain, for example in order to assist or counteract gravitational conveying, wherein the grain is not however to be completely prevented from being conveyed towards the oversize grain conveyor. It is expediently formed as an at least substantially smooth side wall and preferably as an at least substantially planar side wall. In modifications, the inclination from the upper region towards the lower region can also vary, for example increase or as applicable decrease, and the channelling means can exhibit a correspondingly convex or concave shape as viewed from the oversize grain conveyor. A simple slant is however preferred. The channelling means performs a channelling function by catching at least some of the oversize grain which is conveyed over the side edge and correspondingly falls onto the channelling means and slides or rolls on the channelling means towards the oversize grain conveyor. It can act as a funnel wall. In the performance of its channelling function, it can also form a lateral limit for the oversize grain conveyor and can prevent oversize grain which is channelled onto or possibly falls directly onto the oversize grain conveyor from being able to fall laterally back off the oversize grain conveyor.

In modifications, the channelling means itself can be formed as an additional screen, for example an additional roller screen or a rigid mesh screen, wherein its screening function can in particular be that of letting fine grain, which may be conveyed over the side edge together with the oversize grain, fall through the additional screen and channelling only the actual oversize grain towards the oversize grain conveyor. A fine grain fraction which can for example still adhere to the oversize grain conveyed over the side edge can then be dislodged by its impact on the channelling means.

In one development, a fine grain conveyor for removing the fine grain which falls through the roller screen is arranged below the roller screen. Instead of a fine grain conveyor, it is also possible to arrange just a collecting container for the fine grain below the roller screen, alongside the oversize grain conveyor in the plan view, either as a constituent part of the sorting device which can be driven or transported or as an additional container which is only added and/or arranged below the roller screen once the sorting device is at the site of operations. An active fine grain conveyor does however have the advantage that the fine grain can be removed from the region of the roller screen as required, continuously or as applicable also discontinuously but at any rate automatically, without an additional conveying means. In particular, the roller operations do not have to be interrupted in order to remove accumulated fine grain.

The oversize grain conveyor and/or the optional fine grain conveyor can in particular be a conveyor comprising a continuously rotating conveyance, preferably a conveyor belt, on which the respective grain can lie as it is removed below the roller screen.

The roller conveying direction which points towards the channelling means can in particular point in the longitudinal direction of the rollers, i.e. parallel to the rotational axes of the sorting rollers. This applies at least when the sorting rollers are spiral or helical rollers, as is preferred. Such sorting rollers convey a compact oversize grain—within a grain size range specific to the roller screen—in the longitudinal direction of the rollers, and convey a comparatively more elongated oversize grain transverse to the longitudinal direction of the rollers. A roller screen which is formed from or with spiral and/or helical rollers is correspondingly able to separate the oversize grain into two different oversize grain fractions. If such a roller screen is used, the roller conveying direction mentioned preferably coincides with the longitudinal direction of the rollers, such that the compact oversize grain is conveyed by means of the channelling means. The larger or more elongated oversize grain is conveyed transverse to the longitudinal direction of the rollers, on the roller screen, towards and preferably over another side edge of the roller screen. If, however, the roller screen is conversely formed from disc rollers or star rollers or other rollers which substantially convey the oversize grain only transverse to the longitudinal direction of the rollers, then the channelling means correspondingly extends at least substantially parallel to the sorting rollers of such a roller screen. With regard to the functionality of different types of roller screen, reference is made to EP 1 570 919 B1 (for the spiral or helical roller screen) and EP 1 088 599 B1 (for a disc or star roller screen), both already mentioned at the beginning. The roller screen can in particular be formed as described in these documents.

Advantageous features are also disclosed in the sub-claims and in the combinations of the sub-claims.

In the following, wherever features of the invention are described as or in aspects, these aspects which are worded in the manner of claims, or also merely partial aspects from them, can develop or supplement the subject-matter of the claims. Within the context of a divisional application, the claims can also be completely or partially replaced with one or more of the aspects. Wherever reference signs are used in the features characterised as aspects, these are the reference signs from example embodiments which are described further below. The aspects are not restricted to these example embodiments, although the example embodiments illustrate possible embodiments which are preferred both for the features described within the claims and for the features described within the aspects.

Aspect 1 A sorting device for sorting a material mixture into fractions of different grain, wherein the sorting device can be driven or transported by road or rail and comprises:
(a) a frame (1);
(b) sorting rollers (5) which are supported on the frame (1) and arranged alongside each other such that they can be rotary-driven and which together form a roller screen (6) for sorting the material mixture into a fine grain which falls through the roller screen (6) and an oversize grain which can be conveyed by the sorting rollers (5) in a roller conveying direction (Y) over a side edge of the roller screen (6);
(c) and a channelling means (20) which extends along the side edge and is inclined in an operating position counter to the roller conveying direction (Y), at least in sections, between an upper region, which faces the side edge at a distance, and a lower region, in order to channel oversize grain, which is conveyed in the roller conveying direction (Y) over the side edge of the roller screen (6), downwards and counter to the roller conveying direction (Y), preferably until it is below the roller screen (6).

Aspect 2 The sorting device according to the preceding aspect, comprising an oversize grain conveyor or collector (12), arranged below the sorting rollers (5), for removing or collecting the oversize grain conveyed over the side edge of the roller screen (6).

Aspect 3 The sorting device according to the preceding aspect, wherein the lower region of the channelling means (20) is near the oversize grain conveyor or collector (12) in order to channel the oversize grain, which is conveyed over the side edge of the roller screen (6), downwards to the oversize grain conveyor or collector (12) in the operating position.

Aspect 4 A sorting device for sorting a material mixture into fractions of different grain, wherein the sorting device can be driven or transported by road or rail and comprises:
(a) a frame (1);
(b) sorting rollers (5) which are supported on the frame (1) and arranged alongside each other such that they can be rotary-driven and which together form a roller screen (6) for sorting the material mixture into a fine grain which falls through the roller screen (6) and an oversize grain which can be conveyed by the sorting rollers (5) in a roller conveying direction (Y) over a side edge of the roller screen (6);
(c) an oversize grain conveyor or collector (12), arranged below the sorting rollers (5), for removing or collecting the oversize grain conveyed over the side edge of the roller screen (6);
(d) and a channelling means (20) which extends along the side edge and is inclined in an operating position towards the oversize grain conveyor or collector (12), at least in sections, between an upper region, which faces the side edge at a distance, and a lower region near the oversize grain conveyor or collector (12), in order to channel oversize grain, which is conveyed in the roller conveying direction (Y) over the side edge of the roller screen (6), downwards to the oversize grain conveyor or collector (12).

Aspect 5 The sorting device according to at least one of the preceding aspects, wherein the channelling means (20) can be moved, preferably pivoted, back and forth between the operating position and a resting position which is nearer the side edge, in order to be able to decrease the overall dimensions of the sorting device, preferably an overall transport width which is smaller than an overall transport length, as viewed in a plan view.

Aspect 6 The sorting device according to at least one of the preceding aspects, wherein the channelling means (20) forms a wall, preferably an external side wall of the sorting device, which can be pivoted out into the operating position and pivoted back towards the side edge of the roller screen (6) into a resting position.

Aspect 7 The sorting device according to at least one of the preceding aspects, wherein the channelling means (20) can be pivoted back and forth, about a pivot axis (P) which is located lower than the roller screen (6) and extends at least substantially parallel to the side edge, between the operating position and a resting position which is nearer the side edge.

Aspect 8 The sorting device according to the preceding aspect, wherein the pivot axis (P) extends, as viewed in a plan view onto the roller screen (6), within a strip which is parallel to the side edge of the roller screen (6) and overlaps the side edge and which has a width, as measured in the conveying direction (Y), of at most one meter (1 m) and protrudes outwards—in the conveying direction (Y)—beyond the side edge by at most 30 cm.

Aspect 9 The sorting device according to at least one of the preceding aspects, wherein the channelling means (20) comprises a lower end which extends up to a lateral edge of or over or onto the oversize grain conveyor (12) in the operating position.

Aspect 10 The sorting device according to the preceding aspect, wherein the channelling means (20) can be moved back and forth between the operating position and a resting position which is nearer the side edge, and comprises a flexible and/or freely protruding strip at its lower end, wherein said strip laterally limits the oversize grain conveyor or collector (12) when the channelling means (20) is in the operating position, preferably by making contact with it, in order to prevent oversize grain from accumulating between the channelling means (20) and the oversize grain conveyor or collector (12).

Aspect 11 The sorting device according to at least one of the preceding aspects, wherein the roller conveying direction (Y) points in the longitudinal direction of the rollers and the channelling means (20) extends along a side-face of the sorting rollers (5).

Aspect 12 The sorting device according to at least one of the preceding aspects, comprising a retaining structure (21) which is arranged in a corner region of the roller screen (6) at the channelling means (20) and, in an operating position, prevents oversize grain from being moved transverse to the roller conveying direction (Y) and past the channelling means (20).

Aspect 13 The sorting device according to the preceding aspect, wherein the retaining structure (21) can be moved, preferably pivoted, from the operating position to a resting position, in order to be able to decrease the overall dimensions of the sorting device, preferably an overall transport width which is smaller than an overall transport length, as viewed in a plan view.

Aspect 14 The sorting device according to at least one of the immediately preceding two aspects, wherein the retaining structure (21) is mechanically coupled to the channelling means (20) such that the retaining structure (21) can be moved back and forth between the operating position and the resting position together with the channelling means (20).

Aspect 15 The sorting device according to any one of the immediately preceding two aspects, wherein the retaining structure (21) cannot be moved relative to the channelling means (20) and is preferably joined to the channelling means (20).

Aspect 16 The sorting device according to Aspect 13 or Aspect 14, wherein the retaining structure (21) can be moved relative to the channelling means (20).

Aspect 17 The sorting device according to at least one of the preceding aspects, comprising a fine grain conveyor or collector (11), arranged below the sorting rollers (5), for removing or collecting the fine grain which falls through the roller screen (6).

Aspect 18 The sorting device according to at least one of the preceding aspects, comprising an additional conveying means (25) which is arranged below the roller screen (6) and inclined, at least in sections, between an upper region near the side edge of the roller screen (6) and a lower region, in order to channel fine grain, which falls through the roller screen (6), downwards to below the roller screen (6), wherein the additional conveying means (25) preferably extends over the oversize grain conveyor or collector (12) of Aspect 2 or Aspect 4, in order to channel the fine grain above the oversize grain conveyor or collector (12) downwards.

Aspect 19 The sorting device according to the preceding aspect, comprising a fine grain conveyor or collector (11), arranged below the sorting rollers (5), for removing or collecting the fine grain which falls through the roller screen (6), wherein the additional conveying means (25) is inclined towards the fine grain conveyor or collector (11) and extends up to or almost up to the fine grain conveyor or collector (11), in order to channel fine grain which falls through the roller screen (6), preferably above the optional oversize grain conveyor or collector (12), downwards to the fine grain conveyor or collector (11).

Aspect 20 The sorting device according to at least one of the preceding aspects, comprising a fine grain conveyor (11), arranged below the sorting rollers (5), for removing the fine grain which falls through the roller screen (6), and/or an oversize grain conveyor (12), arranged below the sorting rollers (5), for removing the oversize grain conveyed over the side edge of the roller screen (6), and a transverse conveyor (13), arranged downstream of either the fine grain conveyor (11) or the oversize grain conveyor (12), for removing either the fine grain which can be delivered by the fine grain conveyor (11) or the oversize grain which can be delivered by the oversize grain conveyor (12), wherein a conveying direction (Y) of the transverse conveyor (13) points transverse to a conveying direction (X) of either the fine grain conveyor (11) or the oversize grain conveyor (12) and/or at least substantially parallel to the roller conveying direction (Y), and the transverse conveyor (13) is preferably disposed to discharge either the fine grain or the oversize grain from the region of the frame (1).

Aspect 21 The sorting device according to at least one of the preceding aspects, comprising a feed means (3, 4) for feeding the material mixture to the roller screen (6), wherein the feed means (3, 4) comprises a conveyor (4) comprising a rotating conveyance, such as for example a conveyor belt (4), and/or a vibration means (3), preferably a vibrating channel (3) which can be vibrationally driven, for loosening and vibrationally conveying the material mixture which is to be conveyed to the roller screen (6).

Aspect 22 The sorting device according to at least one of the preceding aspects, comprising a feed means (3, 4) for feeding the material mixture to the roller screen (6), wherein the feed means (3, 4) is arranged for conveying the material mixture onto the roller screen (6) transverse to the roller conveying direction (Y).

Aspect 23 The sorting device according to at least one of the preceding aspects, comprising a fine grain conveyor (11), arranged below the sorting rollers (5), for removing a fine grain which falls through the roller screen (6), and one or more metal separators (14, 16) arranged downstream of the fine grain conveyor (11), preferably a magnetic separator (14) and/or an eddy current separator (16), for separating metal from the fine grain conveyed by the fine grain conveyor (11), wherein if there are a number of metal separators (14, 16), preferably one metal separator (14) for ferrous metals and another metal separator (16) for non-ferrous metals are provided.

Aspect 24 The sorting device according to the preceding aspect, wherein at least a portion of the metal separator (14) extends above the fine grain conveyor (11).

Aspect 25 The sorting device according to any one of the immediately preceding two aspects, wherein the fine grain conveyor (11) comprises a downstream end at which the fine grain is removed from the fine grain conveyor (11) in free fall, and the metal separator (14) which is formed as a magnetic separator is arranged above or alongside the downstream end, in order to attract ferrous metals from the fine grain in free fall and separate them at the metal separator (14).

Aspect 26 The sorting device according to any one of the immediately preceding three aspects, wherein the metal separator (14; 16) comprises a conveyance for conveying the metal separated at the metal separator (14; 16).

Aspect 27 The sorting device according to any one of the immediately preceding four aspects, wherein a metal remover (15) for the metal separated from the fine grain by the metal separator (14) is arranged downstream of the metal separator (14), wherein the metal remover (15) is preferably disposed to discharge the metal from the region of the frame (1).

Aspect 28 The sorting device according to at least one of the immediately preceding five aspects and Aspect 20, wherein the metal separator (14) extends over the transverse conveyor (13).

Aspect 29 The sorting device according to the preceding aspect, wherein the metal separator (14) extends over the transverse conveyor (13) up to a metal remover (15) for the metal, in order to convey the separated metal to the metal remover (15) by means of the metal separator (14) and convey it onwards by means of the metal remover (15), wherein the metal remover (15) is preferably disposed to discharge the metal from the region of the frame (1).

Aspect 30 The sorting device according to Aspect 23, wherein a downstream conveying portion (11*a*) of the fine grain conveyor (11), or an additional fine grain conveyor using which the fine grain conveyed by the fine grain conveyor (11) can be conveyed onwards, extends over the metal separator (16) in order to convey the fine grain onto the metal separator (16).

Aspect 31 The sorting device according to the preceding aspect, wherein the metal separator (14) described in any one of Aspects 24 to 27 is likewise provided.

Aspect 32 The sorting device according to at least one of the preceding aspects, comprising a fine grain conveyor (11), arranged below the sorting rollers (5), for removing a fine grain which falls through the roller screen (6), and an additional screen (18), arranged downstream of the fine grain conveyor (11), for sorting the fine grain which can be conveyed by the fine grain conveyor (11) to the additional screen (18) into ultrafine grain which falls through the additional screen (18) and residual fine grain which is conveyed on the additional screen (18).

Aspect 33 The sorting device according to at least one of the preceding aspects in combination with Aspect 23, comprising an additional fine grain conveyor or collector (15; 17; 18), arranged downstream of the metal separator (14; 16), for conveying onwards or collecting the fine grain which is not separated by the metal separator (14; 16) and preferably conveying it onwards towards the transverse conveyor (13) described in Aspect 20.

Aspect 34 The sorting device according to the preceding aspect, wherein the additional fine grain conveyor or collector (15; 17) is formed as a conveyor and comprises a conveyor (15; 17) comprising a rotating conveyance, preferably a conveyor belt, and/or a vibration conveyor.

Aspect 35 The sorting device according to any one of the immediately preceding two aspects, wherein the additional fine grain conveyor or collector (18) is formed as a conveyor and comprises an additional screen for sorting the fine grain which is not separated by the metal separator (14; 16) into ultrafine grain which falls through the additional screen and residual fine grain which is conveyed on the additional screen.

Aspect 36 The sorting device according to at least one of Aspects 23, 30, 31 and 33 to 35, wherein a dividing wedge (26) is arranged near one end of the metal separator (16) such that the metal separator (16) conveys, preferably catapults, the metal over the dividing wedge (26), while the non-metallic fine grain is conveyed between the metal separator (16) and the dividing wedge (26) and onto or into the additional fine grain conveyor or collector (17; 18), preferably by gravity.

Aspect 37 The sorting device according to at least one of the preceding aspects in combination with Aspect 32 and/or 35, wherein the additional screen (18) comprises a number of sorting rollers, preferably star rollers or disc rollers, which are arranged alongside each other such that they can be rotary-driven and which together form an additional roller screen (18).

Aspect 38 The sorting device according to at least one of Aspects 32, 35 and 37, wherein an ultrafine grain conveyor or collector (19) for conveying or collecting the ultrafine grain is arranged below the additional screen (18).

Aspect 39 The sorting device according to the preceding aspect, comprising a transverse conveyor (29), arranged downstream of the ultrafine grain conveyor or collector (19) which is formed as a conveyor, for discharging the ultrafine grain from the sorting device, wherein a conveying direction (Y) of this transverse conveyor (29) points transverse to a conveying direction (X) of the fine grain conveyor (11) and/or the oversize grain conveyor (12) and/or at least substantially parallel to the roller conveying direction (Y).

Aspect 40 The sorting device according to at least one of the preceding aspects, comprising a discharge means (8, 9) which is arranged downstream of the roller screen (6), wherein the oversize grain which is conveyed over the side edge by means of the oversize grain conveyor (12) described in Aspect 2 or Aspect 4 and/or an oversize grain which is conveyed on the roller screen (6) transverse to the roller conveying direction (Y) can be delivered to the discharge means (8, 9) which serves to discharge the delivered oversize grain from the sorting device.

Aspect 41 The sorting device according to at least one of the preceding aspects, comprising an oversize grain conveyor (12), arranged below the sorting rollers (5), for removing the oversize grain which is conveyed over the side edge of the roller screen (6), wherein a conveying direction (X) of the oversize grain conveyor (12) points at least substantially transverse to the roller conveying direction (Y).

Aspect 42 The sorting device according to at least one of the preceding aspects, comprising a fine grain conveyor (11), arranged below the sorting rollers (5), for removing a fine grain which falls through the roller screen (6), wherein a conveying direction (X) of the fine grain conveyor (11) points at least substantially transverse to the roller conveying direction (Y).

Aspect 43 The sorting device according to the preceding aspect, wherein the fine grain conveyor (11) and the oversize grain conveyor (12) are arranged alongside each other in a plan view and/or exhibit at least substantially parallel, mutually opposite conveying directions (X).

Aspect 44 The sorting device according to at least one of the preceding aspects, wherein the sorting rollers (5) are spiral and/or helical rollers.

Aspect 45 The sorting device according to at least one of the preceding aspects, wherein the sorting rollers (5) are rotationally mounted on only one roller bearing side and each project freely in the longitudinal direction (Y) of the rollers, and the channelling means (20) extends along the side-faces of the sorting rollers (5) which face away from the roller bearing side in the longitudinal direction (Y) of the rollers.

Aspect 46 The sorting device according to at least one of the preceding aspects, wherein the sorting rollers (5) sort the material mixture according to a first fraction and a second fraction which differ from each other in terms of grain size and/or grain weight and/or another geometric and/or physical characteristic, and convey the first fraction as the oversize grain in the roller conveying direction (Y) to the channelling means (20) and convey the second fraction as another oversize grain transverse to the roller conveying direction (Y) over another side edge of the roller screen (6) onto an oversize grain discharge means (8, 9).

Aspect 47 The sorting device according to at least one of the preceding aspects, comprising one or more discharge means (8, 9, 13, 29) for discharging a grain fraction (each) which can be sorted from the material mixture by means of the sorting device, wherein the respective discharge means can be moved (switched) back and forth, preferably automatically by means of a drive, between a resting position or transport position in which it is retracted onto and/or into the frame (1) and an operating position in which it is extended.

Aspect 48 The sorting device according to at least one of the preceding aspects, comprising a mobile substation (2) which carries the frame (1).

Aspect 49 The sorting device according to the preceding aspect, wherein the substation (2) comprises a wheel drive, roller drive, caterpillar drive or chain drive.

Aspect 50 The sorting device according to at least one of the preceding aspects, wherein the sorting device comprises one or more drive motors, preferably one or more electric motors, and can be driven by itself.

Aspect 51 The sorting device according to at least one of the preceding aspects, comprising: a generator and/or storage for electrical energy which is arranged preferably on the frame (1) and can in particular be formed as an internal combustion engine together with an attached electric generator, accumulator or fuel cell; and one or more electric motors which is/are (each) connected to the generator and/or storage in order to be supplied with electrical energy.

Aspect 52 The sorting device according to at least one of the preceding aspects, wherein the roller screen (6) is inclined at an angle of more than 0° to a horizontal plane in the roller conveying direction (Y) which is preferably also the longitudinal direction (Y) of the rollers, in order to convey the oversize grain in the roller conveying direction (Y), against gravity.

Aspect 53 The sorting device according to at least one of the preceding aspects, wherein an inclination of the roller screen (6) in relation to a horizontal plane can be adjusted, preferably by pivoting the roller screen (6), wherein in at least one position of the roller screen (6) which can be set, the longitudinal direction (Y) of the sorting rollers (5) points parallel to the horizontal plane in each case, and in another position of the roller screen (6) which can be set, the longitudinal direction (Y) of the sorting rollers (5) is inclined at an angle of more than 0° to the horizontal plane in each case, in order to convey the oversize grain in the roller conveying direction (Y), against gravity, in said other position.

Aspect 54 The sorting device according to at least one of the preceding aspects and at least one of Aspects 5, 6, 7, 8 and 10, wherein when the channelling means (20) is in its resting position, the sorting device exhibits an overall width, as measured in the roller conveying direction (Y), of at most 3 m, preferably at most 2.5 m.

Aspect 55 The sorting device according to at least one of the preceding aspects and at least one of Aspects 5, 6, 7, 8 and 10, wherein when the channelling means (20) is in its resting position, the sorting device—excluding only the set of wheels (2) of Aspect 48, or even including the set of wheels (2) of Aspect 48—exhibits overall measured external dimensions (length, width, height) which are at most as large as the external dimensions of an ISO container according to ISO standard 668, wherein at least the overall measured width and preferably also the overall measured height and/or the overall measured length of the sorting device preferably measures at least 80% of the corresponding external dimensions of the ISO container.

DESCRIPTION OF THE DRAWINGS

Example embodiments of the invention are described below on the basis of figures. Features disclosed by the example embodiments, each individually and in any combination of features, advantageously develops the subject-matter of the claims as well as the embodiments and aspects described above. There is shown:

DETAILED DESCRIPTION OF THE INVENTION

Figure 1:
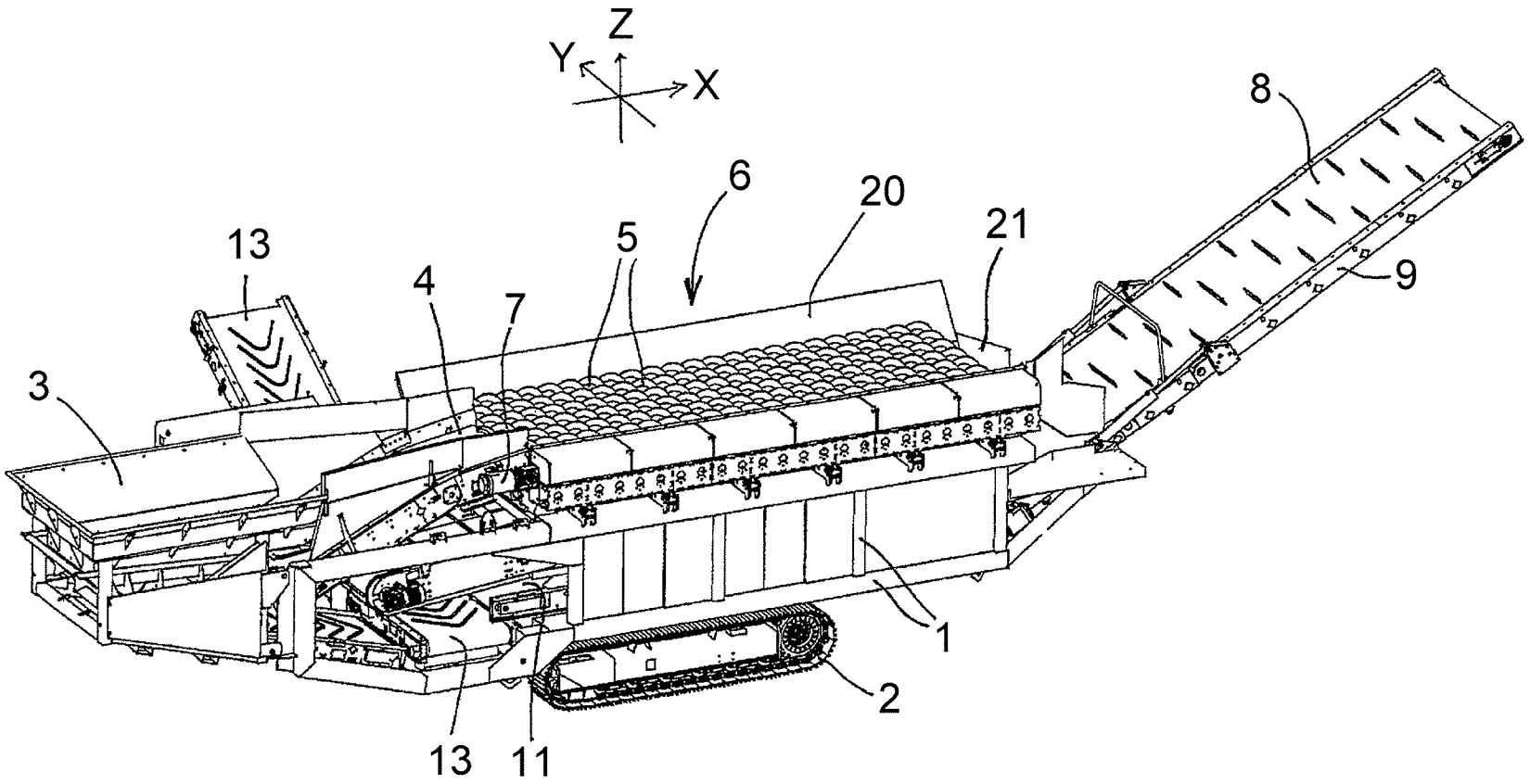
FIG. 1 a sorting device of a first example embodiment, in an operational mode, in a first perspective view.

FIG. 1 shows a sorting device of a first example embodiment, in a perspective view. The sorting device is in an operational mode. It comprises a frame 1 and a set of wheels 2 which carries the frame 1. The set of wheels 2 comprises a caterpillar drive, such that the sorting device can be transported as a whole, in one unit, at the site of operation and can in principle also travel short distances by road, providing it is licensed. The caterpillar drive can for example be replaced with a chain drive and in principle also with a gear drive or roller drive, wherein a chain drive and in particular a caterpillar drive is however preferred.

A number of sorting rollers 5 are supported on the frame 1 and mounted alongside each other, such that they can be rotated about their respective longitudinal axis, and can be rotary-driven by means of a roller drive 7. The sorting rollers 5 together form a roller screen 6 for sorting, including separating, a material mixture which can be introduced onto the roller screen 6 into an undersize or fine grain fraction, referred to in the following as fine grain, which falls through the roller screen 6 and at least one oversize grain fraction, referred to in the following as oversize grain, which remains on the roller screen 6 and is conveyed in a roller conveying direction.

The sorting rollers 5 are embodied as spiral and/or helical rollers, as is preferred but merely by way of example. The roller screen 6 is able to sort the oversize grain fraction into a first oversize grain which is conveyed in the longitudinal direction Y of the rollers and a second oversize grain which is conveyed transverse to the longitudinal direction Y of the rollers. The first oversize grain is conveyed in the Y direction to a first side edge, and the second oversize grain is conveyed in the longitudinal direction X of the sorting device, which coincides with the driving or transport direction, to a second side edge of the roller screen 6. Since the two side edges are not limited when the sorting device in its in operational mode, the first oversize grain and the second oversize grain are conveyed by the sorting rollers 5 past the respective side edge and thus removed from the roller screen 6. Sorting, including separating, into first oversize grain and second oversize grain depends in particular on the clear distances between each two adjacent sorting rollers 5 and on the pitch of the spiral or threaded flights of the sorting rollers 5 in relation to the roller conveying direction Y. The weight of the oversize grains also plays a certain part. Comparatively elongated oversize grains, which tend to be lighter, are conveyed in the conveying direction X, and oversize grains which are compact in terms of their external dimensions, which are more spherical or cubic, are conveyed in the longitudinal direction of the rollers and roller conveying direction Y. Compact but overly large oversize grains, which are sufficiently large that they do not engage with the spiral or threaded flights, are likewise conveyed substantially in the conveying direction X.

The sorting rollers 5 are mounted on the frame 1 at only one of their ends, the end at which they can be rotary-driven, and project freely from this roller bearing side in the roller conveying direction Y, i.e., they are in an overhung position. Their free end-faces form the first side edge of the roller screen 6 which is associated with the roller conveying direction Y.

The second oversize grain is conveyed in the longitudinal direction X, past an external sorting roller 5 which forms the second side edge, onto a discharge means 8, 9 and is removed by means of the discharge means 8, 9. The discharge means 8, 9 extends in the conveying direction X and/or longitudinal direction of the sorting device in its operational mode and also discharges in the direction X. The discharge means 8, 9 comprises: a rotating conveyance 8 which is formed as a conveying belt, as is preferred; and a discharge frame 9. The discharge means 8, 9 can be extended and retracted between the operating position assumed in FIG. 1 and a transport position which can be seen in FIG. 4. To this end, the discharge frame 9 can be folded about at least two axes, as is preferred but merely by way of example. It can be folded or pivoted about a first axis towards the facing side-face of the frame 1 and about another, more external axis towards the upper side of the sorting device—in this case, towards the roller screen 6. The conveying means 8 is sufficiently flexible that it can extend continuously over the multiple folding segments of the discharge frame 9.

The sorting device also comprises, as an integrated constituent part, a feed means 3, 4 for conveying the material mixture to be sorted onto the roller screen 6. The material mixture, such as for example rubble, excavated earth or quarry waste, is introduced onto the feed means 3, 4 from outside the sorting device, for example by means of a digger or other external deliverer. The feed means 3, 4 comprises a vibration means 3 and, downstream of the vibration means 3, a conveyor 4 which is formed as a conveyor comprising a rotating conveyance, for example as a conveyor belt, as is preferred. The material mixture is introduced onto the vibration means 3 externally, delivered to the conveyor 4 vibrationally or with vibrational assistance in the region of the vibration means 3, and conveyed by the vibration means 3 directly onto the roller screen 6. The vibration means 3 loosens the material mixture in order to make it easier to sort by means of the roller screen 6. The vibration means 3 can in particular be formed as a vibration channel and/or inclined in order to convey the material mixture in the desired direction by means of gravity and with vibrational assistance. The material mixture which has been loosened in this way is conveyed by means of the conveyor 4 in the conveying direction X, i.e., transverse to the longitudinal direction Y of the rollers, onto a corner region of the roller screen 6 which is away from the first side edge associated with the roller conveying direction Y.

It should be noted with regard to the feed means that in simplified embodiments, the feed means can also be formed solely by the vibration means 3 or by the conveyor 4 only. If the feed means were formed solely by the vibration means 3, it would correspondingly be arranged higher than in the example embodiment and would extend as far as the roller screen 6. In even simpler embodiments, the feed means can also be provided externally, i.e., the sorting device can comprise no integrated feed means.

At least a majority of the fine grain contained in the material mixture falls through the roller screen 6 and onto a fine grain conveyor 11 which is arranged below the roller screen 6 and/or sorting rollers 5. The fine grain conveyor 11 is formed, as is preferred but merely by way of example, as a conveyor belt. The fine grain conveyor 11 conveys the fine grain parallel to the conveying direction X—in the example embodiment, counter to the conveying direction X—onto a transverse conveyor 13 which, as is preferred but merely by way of example, is likewise an integrated constituent part of the sorting device. The transverse conveyor 13 forms another discharge means of the sorting device, i.e., a discharge means for the fine grain. In its operational mode, it protrudes beyond the frame 1 on one side, parallel to the longitudinal direction Y of the rollers and advantageously also upwards at that point, in order to convey the discharged fine grain into for example an external collecting container or directly onto an external remover, for example an HGV.

A channelling means 20 extends along the first side edge of the roller screen 6. The channelling means 20 is disposed to channel the oversize grain, which is conveyed in the roller conveying direction Y over the side edge of the roller screen 6, downwards in the manner of a funnel and, as viewed in a plan view onto the roller screen 6, back again towards the side edge and preferably even past the side edge to below the roller screen 6. An optional retaining structure 21 is arranged in an end region of the channelling means 20 facing the discharge means 8, 9 in order to retain oversize grain in the region between the channelling means 20 and the discharge means 8, 9 and prevent it from being able to fall out of the sorting device between the channelling means 20 and the discharge means 8, 9.

Figure 2:
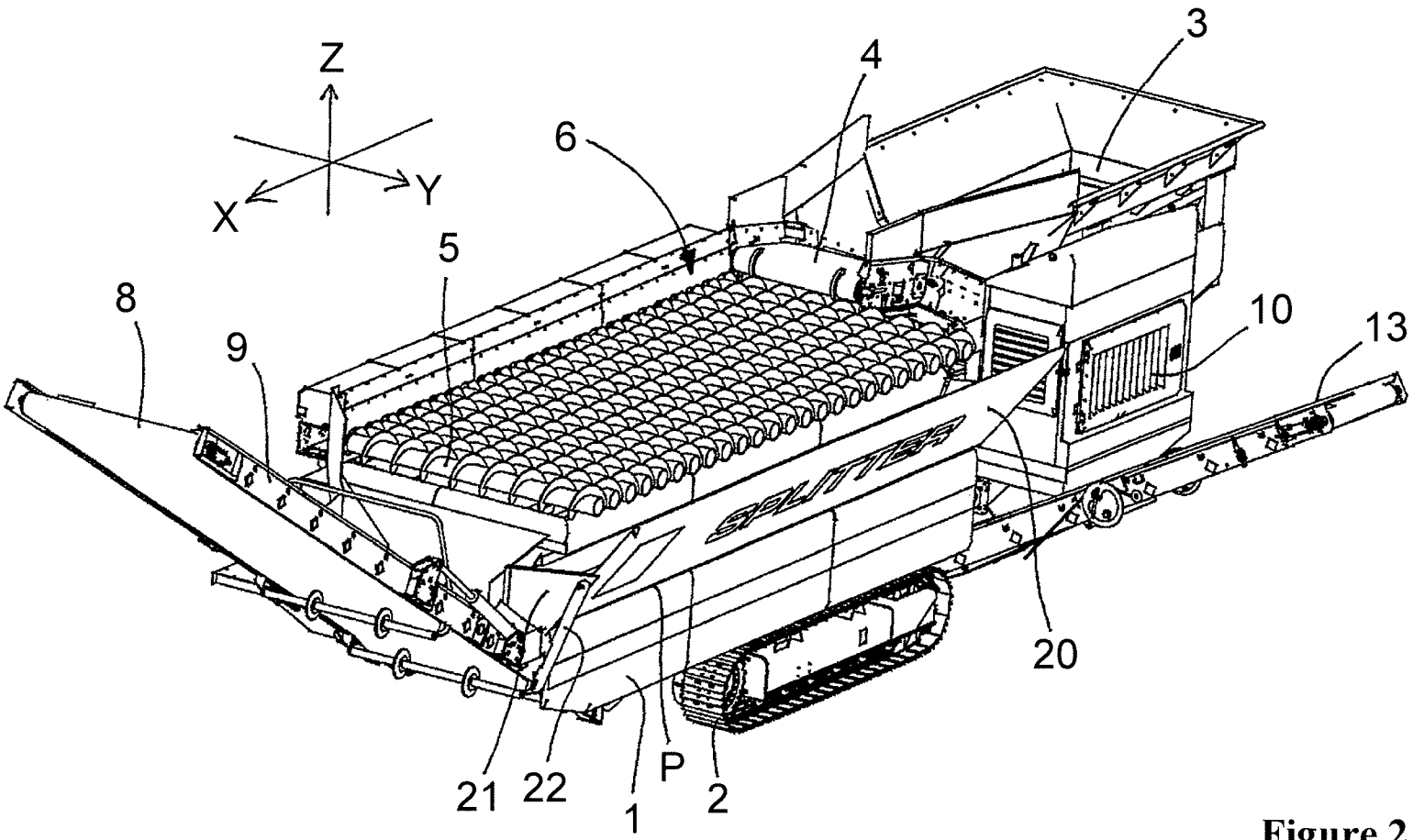
FIG. 2 the sorting device of the first example embodiment, in a second perspective view.

FIG. 2 shows the sorting device of the first example embodiment in its operational mode, in a perspective view onto the side comprising the channelling means 20. The freely projecting sorting rollers 5 can be clearly seen, as can the free first side edge which is formed along the free roller ends and past which the oversize grain—in this case, the compact first oversize grain—is conveyed in the roller conveying direction Y. The channelling means 20 assumes an operating position in which it channels the oversize grain, which is conveyed over the first side edge, downwards and counter to the roller conveying direction Y, back towards the first side edge as viewed in a plan view and preferably even slightly further until it is below the roller screen 6. The retaining function of the retaining structure 21, which broadly seals an intermediate region or gap between the channelling means 20 and the discharge means 8, 9, can also be seen.

The channelling means 20 can be moved back and forth from its operating position to a resting position nearer the facing side edge of the roller screen 6 and from said resting position back to its operating position. The retaining structure 21 can likewise be moved back and forth between the operating position assumed in FIGS. 1 and 2 and a resting position in which it is retracted. Transferring it to the resting position can reduce the overall measured width of the sorting device. This improves the transportability of the sorting device which, due to the nature of the material mixtures to be treated, is bulky.

The channelling means 20 is adjusted and/or switched between the operating position and the resting position by means of an actuating means, for example a hydraulic actuating means. It would in principle be possible to move the channelling means 20 into the operating position and/or resting position manually. An ability to switch it by mechanical and/or motorised means or automatically is however preferred, not least because of the exertion of force required for this purpose.

Preferably, the retaining structure 21 is mechanically coupled to the channelling means 20 such that it can be moved and/or adjusted back and forth together with the channelling means 20. The coupling can be realised by means of a gear system, i.e., the retaining structure 21 can in principle be able to be moved relative to the channelling means 20. More preferably, however, the retaining structure 21 is fixedly connected to the channelling means 20 and cannot be moved relative to it, such that it participates in movements of the channelling means 20 into the operating position or resting position. A support 22 supports the channelling means 20, and preferably together with it the retaining structure 21 if the latter is provided, on the frame 1 in the operating position. The channelling means 20 can for example be moved because the support 22 is guided in an elongated hole as it is moved back and forth or itself comprises an elongated hole with which a bolt, pin or such like of the channelling means 20 or retaining structure 21 engages. The support 22 is expediently arranged in an end region of the channelling means 20, i.e., near a corner region of the roller screen 6. If, as is preferred, it can be adjusted automatically, then an actuating means for moving the channelling means 20 back and forth is provided in the other end region of the channelling means 20. If it can only be manually operated, then another support is expediently provided instead of the actuating means.

The channelling means 20 is connected to the frame 1 such that it can be pivoted; the movement into the resting position and back into the operating position is correspondingly a pivoting movement. A pivot axis of the channelling means 20 is indicated as P. The pivot axis P extends parallel to the associated first side edge of the roller screen 6. It is lower than the associated side edge of the roller screen 6, in relation to a vertical axis Z of the sorting device which points orthogonally with respect to the roller screen 6.

Figure 3:
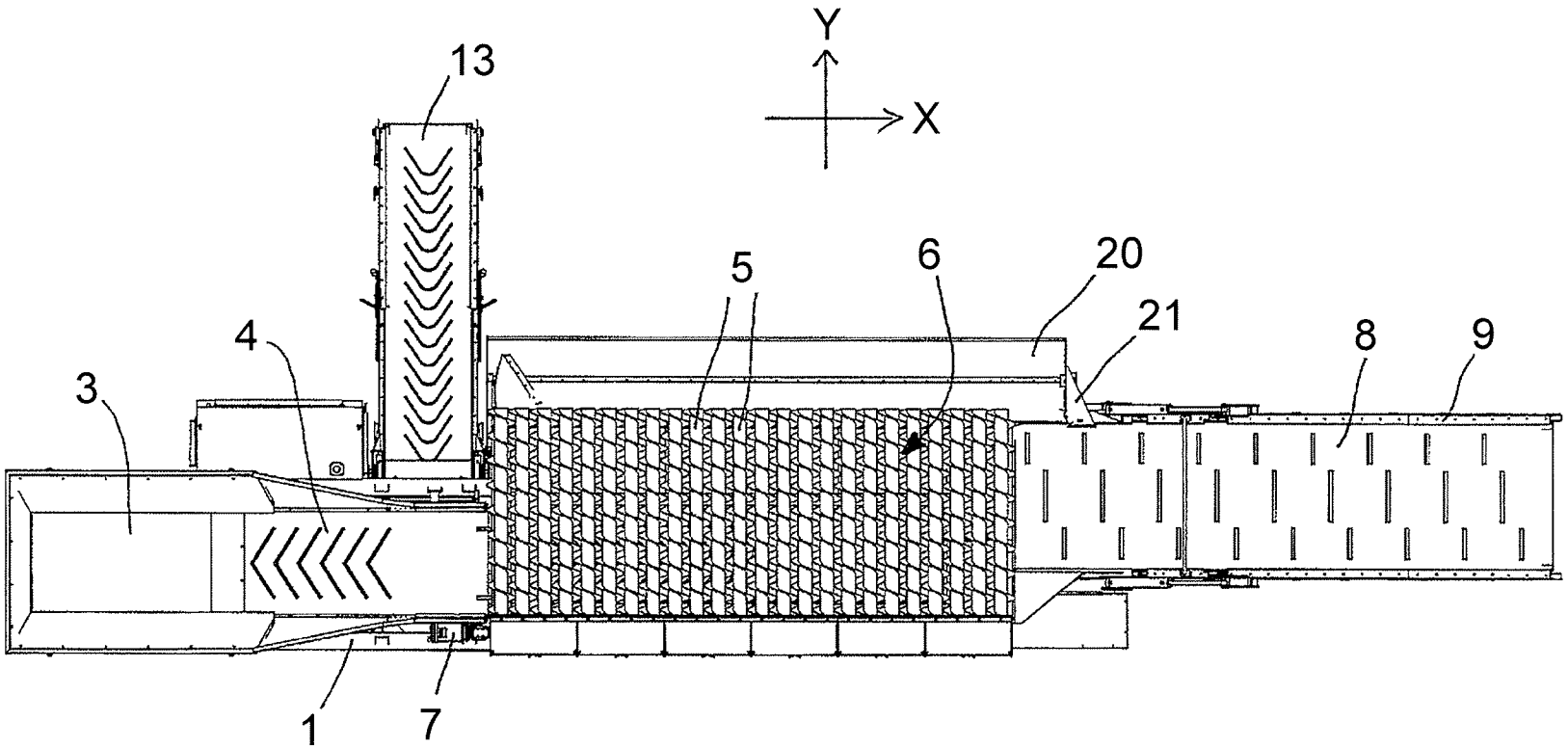
FIG. 3 the sorting device of the first example embodiment, in a plan view.

FIG. 3 shows a plan view of the sorting device in its operational mode, together with the feed means 3, 4, the roller screen 6, the discharge means 8, 9 for the oversize grain, the discharge means for the fine grain which is formed by the transverse conveyor 13, and the channelling means 20. The channelling means 20 and the discharge means 13 and 8, 9 have each assumed their operating position.

Figure 4:
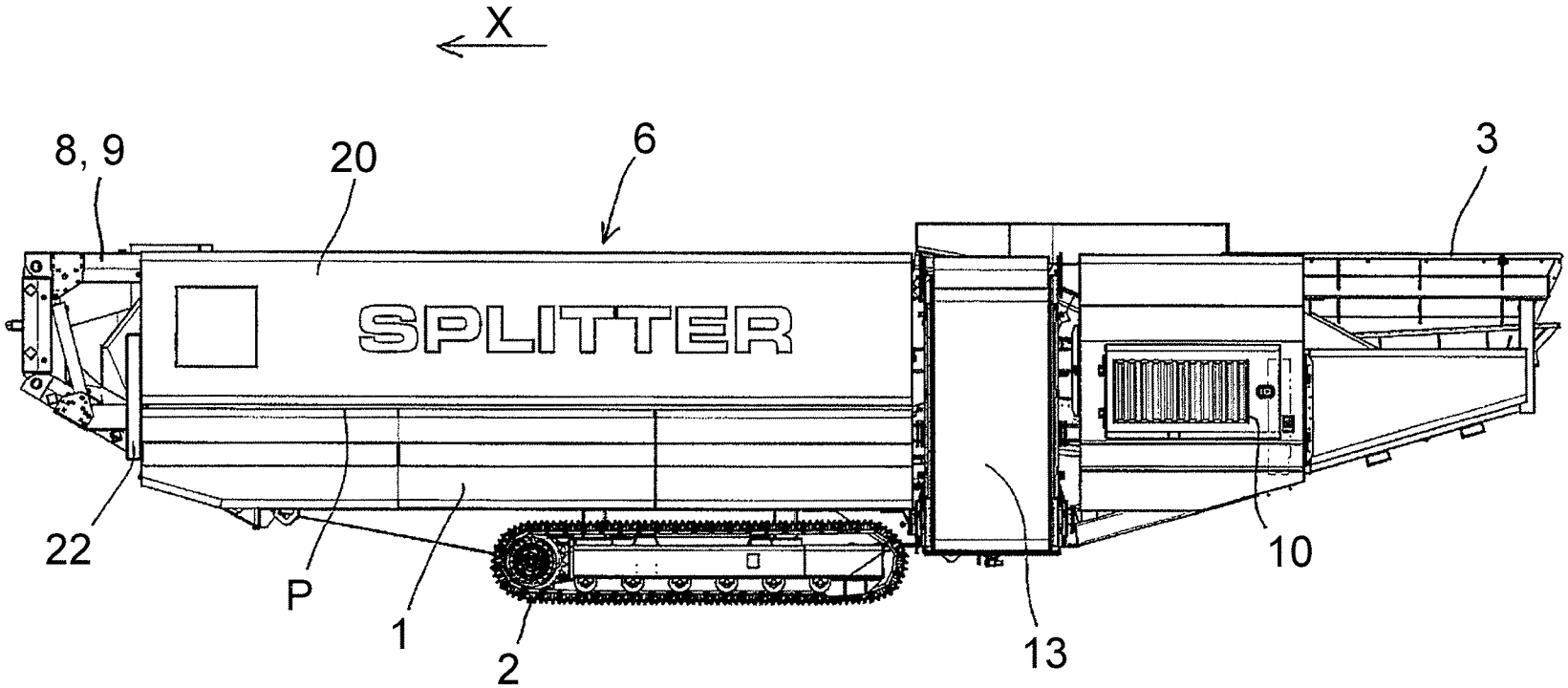
FIG. 4 the sorting device of the first example embodiment, in a transport mode.

FIG. 4 shows the sorting device of the first example embodiment in its transport mode, in a side view onto the channelling means 20. The channelling means 20 has assumed its resting position. If the sorting device comprises transverse conveyors which in their operational mode protrude laterally beyond the frame 1—in the first example embodiment, the transverse conveyor 13 only—then such transverse conveyors and/or discharge means likewise assume a resting position in which they are placed against the frame 1 or retracted into the frame 1, such that the overall measured width of the sorting device as a whole is minimised. As already mentioned, the discharge means 8, 9 which discharges in the X direction can also be transferred from the operating position which is assumed in its operational mode to a resting position for transport, in order to be able to decrease the overall measured length of the sorting device for transport. Correspondingly, the overall length of the sorting device in FIG. 4 is also minimised. As is shown not least by a comparison between FIGS. 1 to 3 and FIG. 4, the discharge means 8, 9 can be folded together about a number of pivoting joints of the discharge frame 9. If, as is preferred, the conveyance 8 is sufficiently flexible, it is correspondingly deformed when folded together. Alternatively, the discharge frame 9 can also serve as a substrate for a number of conveyances arranged sequentially in the conveying direction X. The transverse conveyor 13 likewise comprises a frame and a rotating conveyance which is carried by the frame. The frame of the transverse conveyor 13 can be pivoted about at least one axis, such that the transverse conveyor 13 can be pivoted laterally onto the frame 1. Depending on the length as measured in the Y direction, the frame of the transverse conveyor 13 preferably exhibits another pivot axis, such that its external portion in the operating position can be pivoted towards the upper side of the sorting device. The discharge means 8, 9 and 13 are preferably integrated constituent parts of the sorting device, as in the example embodiment. In simplified embodiments, however, one or both of the discharge means 8, 9 and 13 can instead also be attached or installed only once the sorting device is at the site of operations.

Figure 5:
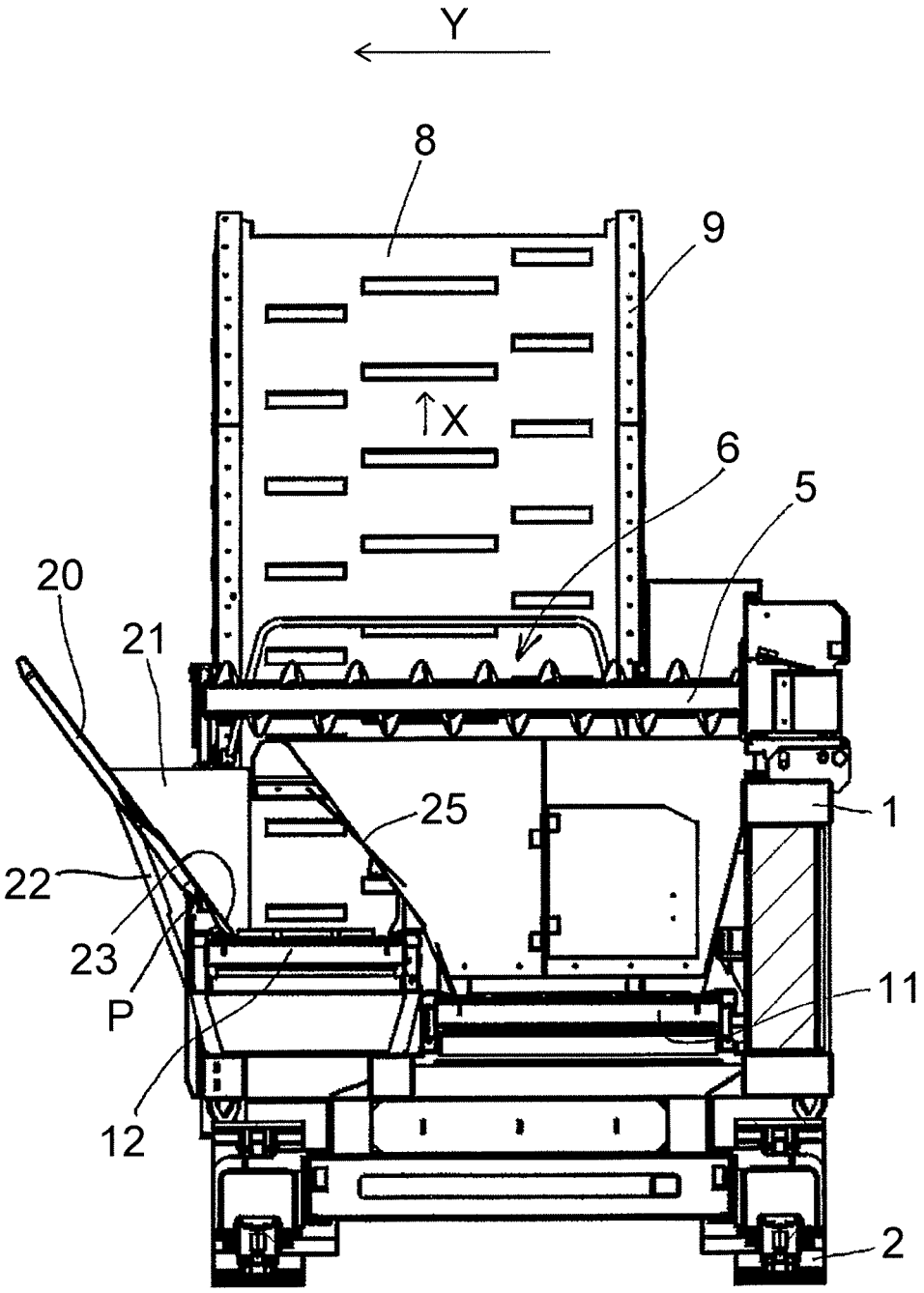
FIG. 5 the sorting device of the first example embodiment, in its operational mode, in a cross-section.
Figure 6:
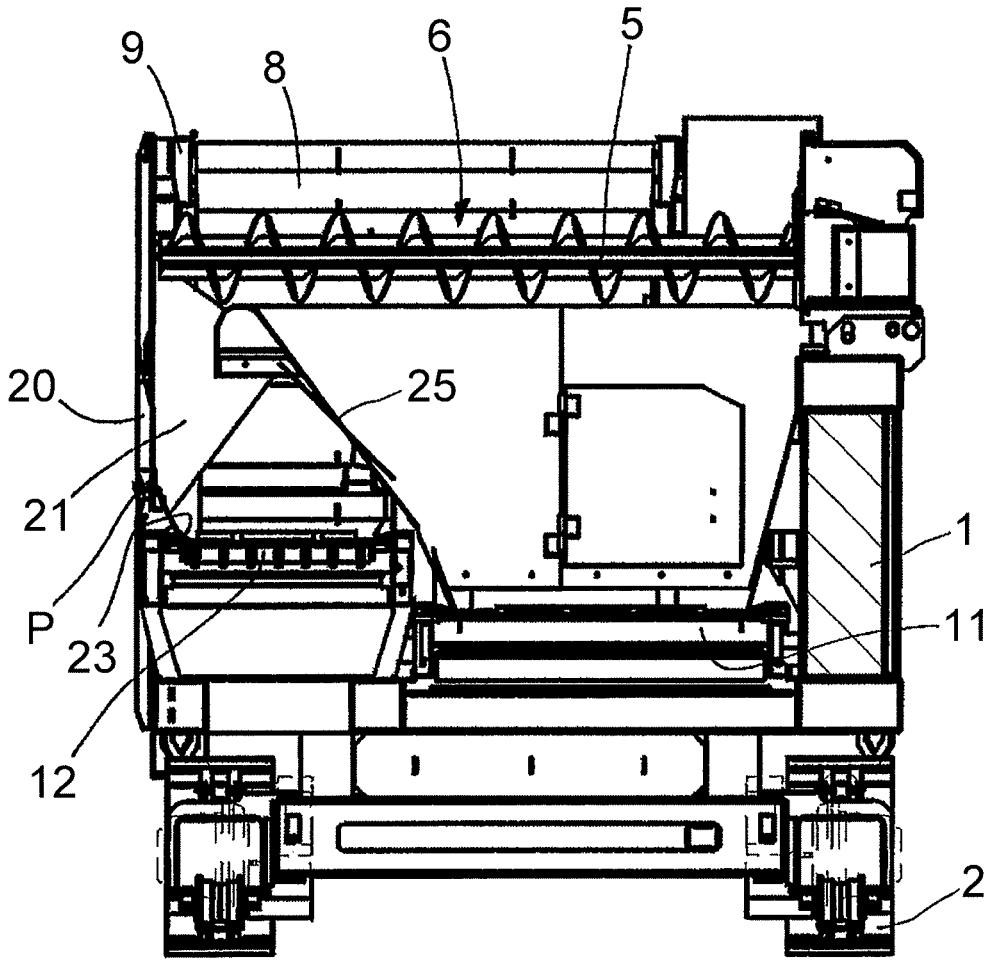
FIG. 6 the sorting device of the first example embodiment, in its transport mode, in cross-section.

FIGS. 5 and 6 each show the sorting device of the first example embodiment in the same cross-section. The cross-section extends in the region of the roller screen 6, parallel to the roller conveying direction Y. In FIG. 5, the sorting device is in its operational mode, and the channelling means 20 and the optional retaining structure 21 have assumed their operating position. The discharge means, i.e., the discharge means 8, 9 and the transverse conveyor 13, have been extended. In FIG. 6, the sorting device is in its transport mode. The channelling means 20 and the optional retaining structure 21 have assumed their resting position, and the discharge means 8, 9 and 13 have been retracted. The plane of the cross-section extends between the discharge means 8, 9 and the transverse conveyor 13, which is not shown because of the viewing direction selected.

The fine grain conveyor 11, which has already been mentioned with respect to FIG. 1, is arranged below the roller screen 6 and removes the fine grain below the roller screen 6, counter to the conveying direction X of the roller screen 6. The fine grain conveyor 11 is formed, as is preferred but merely by way of example, as a conveyor belt.

An oversize grain conveyor 12 is arranged below the roller screen 6 and removes the oversize grain, which is conveyed over the first side edge of the roller screen 6 in the roller conveying direction Y and channelled back again counter to the roller conveying direction Y by the channelling means 20, below the roller screen 6. The oversize grain conveyor 12 extends along the side edge of the roller screen 6 which faces the channelling means 20, underneath a strip-shaped end region of the roller screen 6 which extends up to this side edge. The fine grain conveyor 11 extends underneath a strip region of the roller screen 6 near the roller bearing side. The oversize grain conveyor 12 conveys the oversize grain in the conveying direction X (FIG. 1) to the discharge means 8, 9. The two oversize grain fractions which can be separated from each other by the roller screen 6 are thus converged onto the discharge means 8, 9. In one modification, the oversize grain conveyor 12 can however also be disposed to convey the oversize grain in the opposite direction, i.e., towards the transverse conveyor 13, in order to convey the relevant oversize grain onto another transverse conveyor which is optionally arranged in front of the transverse conveyor 13 and for example discharge it to the other side of the sorting device or also to the same side. The oversize grain conveyor 12 can for example also convey the oversize grain across the transverse conveyor 13 or, in another modification, underneath the transverse conveyor 13, to a downstream conveying and/or screening means or into a collecting container, to name but a few examples.

The oversize grain conveyor 12 is formed, as is preferred but merely by way of example, as a conveyor belt. The two conveyors 11 and 12 are preferably arranged at least substantially such that they convey the respective grain horizontally. The width of the conveyors 11 and 12 as measured in the roller conveying direction Y is preferably different. It is advantageous if the fine grain conveyor 11 has a larger width than the oversize grain conveyor 12.

The oversize grain conveyor 12 is arranged higher than the fine grain conveyor 11. Its vertical distance from the roller screen 6 is correspondingly smaller. This reduces the height of fall of the oversize grain which is conveyed over the side edge. Arranging it higher is nonetheless only an option; the oversize grain conveyor 12 could in principle also exhibit a larger vertical distance from the roller screen 6 than the fine grain conveyor 11.

As can be seen for example in FIG. 5, the channelling means 20 comprises a upper region near the associated side edge of the roller screen 6, and a lower region near the oversize grain conveyor 12. In the operating position, an internal surface of the channelling means 20 which faces the associated side edge is inclined between these two regions—in a simple straight line, i.e., inclined obliquely, in the example embodiment. In preferred simple embodiments, such as that of the example embodiment, the channelling means 20 is formed as an external side wall of the sorting device which can be pivoted as a whole, as a rigid wall structure, about the pivot axis P back and forth between the operating position and the resting position. The upper region of the channelling means 20 comprises a free upper longitudinal end of the channelling means 20. The internal surface which faces the side edge and simultaneously forms the channelling surface for the oversize grain is lengthened in the lower region, as is preferred, over the pivot axis P and the pivoting joint which is correspondingly formed at that point with the frame 1, towards the oversize grain conveyor 12. In this lengthened region, the channelling means 20 can in particular comprise a flexible strip 23 which is advantageously in constant contact with the oversize grain conveyor 12. The strip 23 preferably lies on the upper side of the oversize grain conveyor 12 which faces the roller screen 6. By means of an elastically flexible and for example rubber-like strip 23, it is possible to easily maintain a constant contact and/or to particularly reliably prevent oversize grain from falling laterally off the oversize grain conveyor 12 towards the channelling means 20 and possibly jamming the oversize grain conveyor 12.

In the example embodiment, the channelling means 20 is formed, as is preferred, as a simple wall structure on which the oversize grain which falls off the roller screen 6 is channelled, rolling and/or sliding, towards the oversize grain conveyor 12. In this respect, the channelling means 20 acts like a one-sided funnel. In one further development, it could feature one or more active conveying elements or could itself be formed as an additional screen. Fine grain which may still be adhered to the oversize grain and which is dislodged on impact can be separated from the oversize grain by an additional screen, for example a mesh screen, and for example collected in a container which is set up alongside the sorting device and below the modified channelling means, or removed by means of a conveying means arranged at that point.

Another channelling means 25, an internal channelling means as it were, is arranged below the roller screen 6. The channelling means 25 extends at a corresponding inclination from a lower region near the fine grain conveyor 11, over the oversize grain conveyor 12, towards the side edge of the roller screen 6 which faces and is associated with the channelling means 20. The channelling means 25 performs a channelling and shielding function in that it channels fine grain, which falls through the roller screen 6 while still above the oversize grain conveyor 12, to the fine grain conveyor 11 and thereby simultaneously shields the oversize grain conveyor 12. The channelling means 25 is optional, since the vast majority of the fine grain already falls through the roller screen 6 in the region of the fine grain conveyor 11 because of the arrangement of the feed means 3, 4, and only smaller remnants of fine grain are still conveyed past the fine grain conveyor 11 in the roller conveying direction Y.

Figure 7:
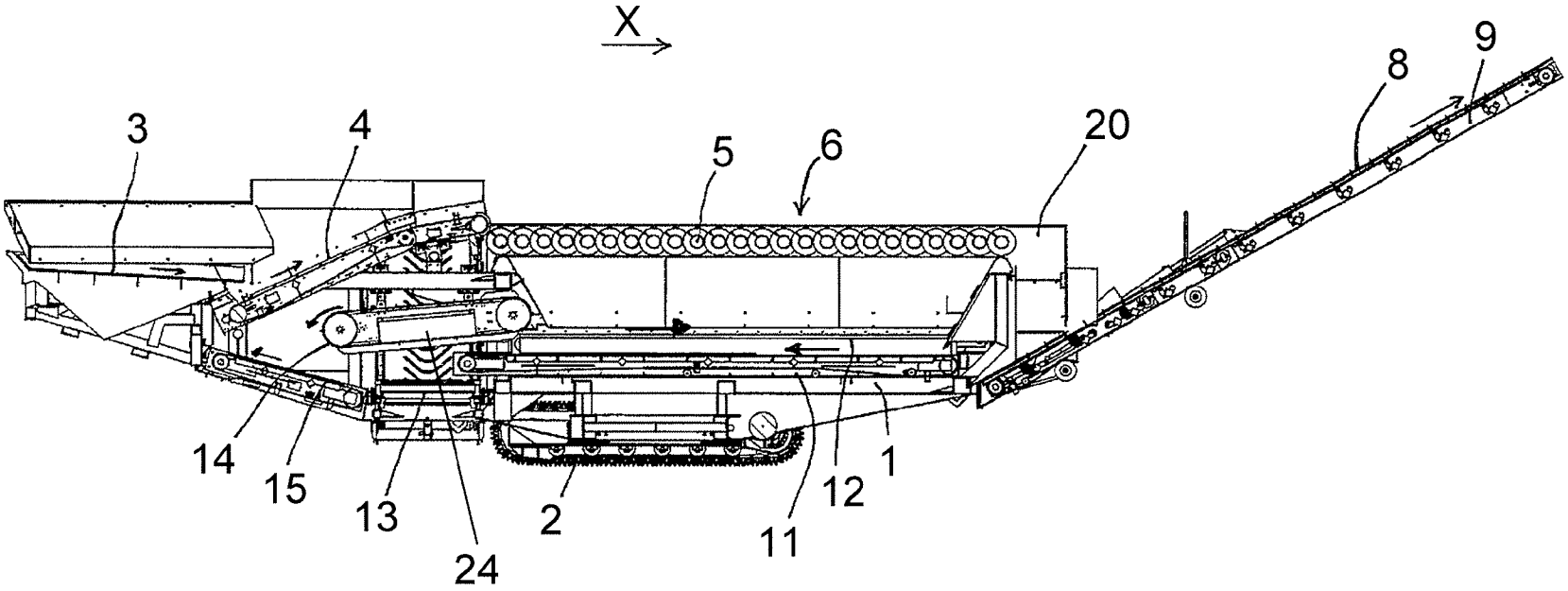
FIG. 7 a sorting device of a second example embodiment, in a longitudinal section.

FIG. 7 shows a sorting device of a second example embodiment in its operational mode, in a longitudinal section which extends through the fine grain conveyor 11, while the oversize grain conveyor 12 can be seen in a side view. The sorting device of the second example embodiment differs from the sorting device of the first example embodiment only in that a metal separator 14 is associated with the fine grain conveyor 11. The fine grain which is conveyed by the fine grain conveyor 11 can be sorted by means of the metal separator 14 into a metallic fraction and a fine grain which is depleted of the separated metal constituents. The metal separator 14 can in particular be a magnetic separator for sorting ferromagnetic constituents from the fine grain. Aside from the separation of metal constituents, the sorting device of the second example embodiment corresponds to the sorting device of the first example embodiment.

The metal separator 14 is formed, as is preferred but merely by way of example, as a conveyor belt comprising a magnetic means 24. It is arranged above a downstream end portion of the fine grain conveyor 11, such that ferromagnetic constituents of the fine grain are attracted upwards away from the fine grain conveyor 11 at that point and conveyed onwards by the metal separator 14. The metal separator 14 is arranged at the downstream end of the fine grain conveyor 11 such that it attracts the metal constituents from the fine grain which falls downwards in free fall from the fine grain conveyor 11 at that point. More specifically, the fine grain describes a trajectory parabola at the downstream end of the fine grain conveyor 11, underneath and near to the magnetic means 24 of the metal separator 14, in accordance with the conveying speed of the fine grain conveyor 11. Separating from fine grain which has been loosened in this way results in a better separating outcome than separating from fine grain which is lying on the fine grain conveyor 11.

The metal separator 14 spans the transverse conveyor 13, as is preferred but merely by way of example, and conveys the ferromagnetic constituents of the fine grain to a metal remover 15 which conveys the metal constituents onwards and preferably discharges them from the sorting device. The metal remover 15 is formed, as is preferred but merely by way of example, as a conveyor belt. It extends to below the metal separator 14. It can discharge the ferromagnetic constituents at its downstream end which faces away from the fine grain conveyor 11, in that the metal constituents fall off the metal remover 15 at that point into an external collecting container below it. The respective conveying direction of the conveyors 3, 4, 8, 9, 11, 12, 14 and 15 is indicated by a directional arrow. In a plan view onto the sorting device, the conveying directions of these conveyors extend parallel to the longitudinal direction X of the sorting device and/or the conveying direction X of the roller screen 6. In modifications, however, the conveying direction of the metal separator 14 and/or the conveying direction of the metal remover 15 can instead for example also point transverse to the longitudinal direction X.

Figure 8:
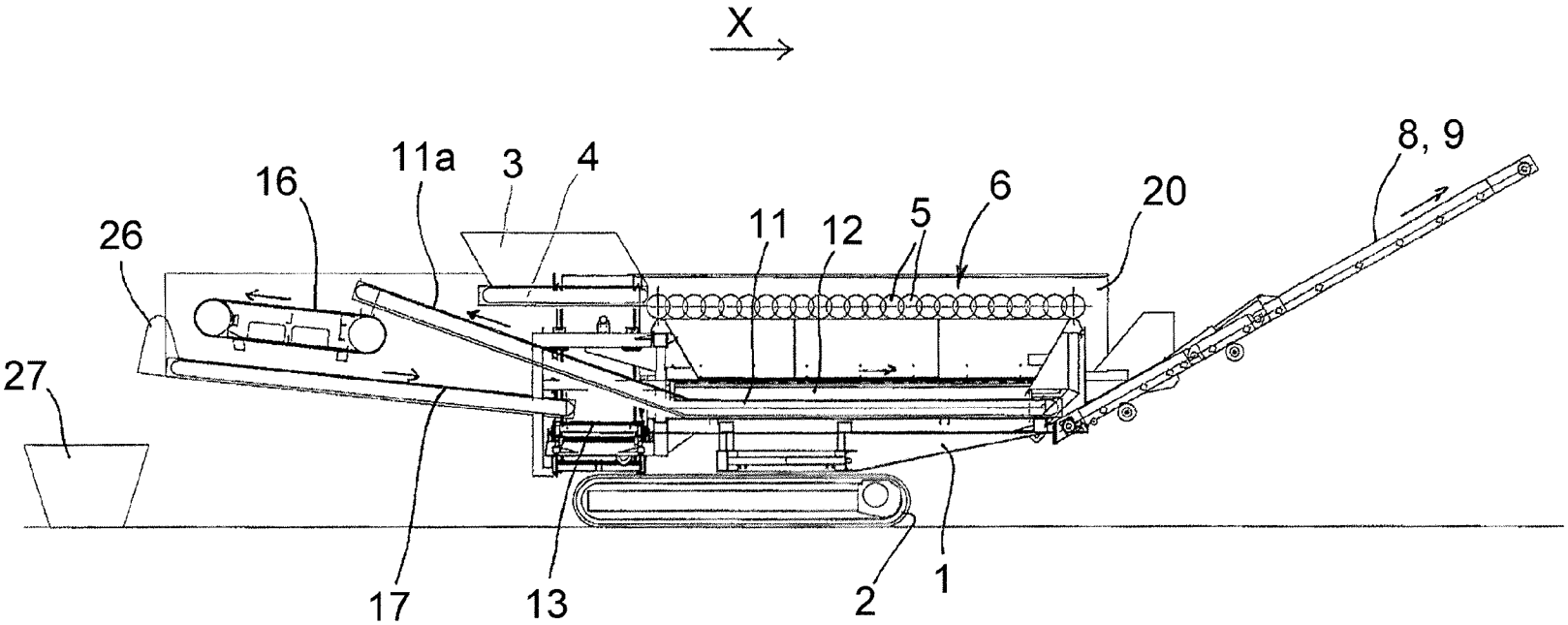
FIG. 8 a sorting device of a third example embodiment, in a longitudinal section.

FIG. 8 shows a sorting device of a third example embodiment, again in a longitudinal section. The sorting device of the third example embodiment also differs from the sorting device of the first example embodiment solely in the separation of a metal fraction from the fine grain which is conveyed by the fine grain conveyor 11. The third example embodiment differs from the second example embodiment in the nature and arrangement of a metal separator 16 and related modifications. The metal separator 16 can in particular be a separator for electrically conductive constituents of the fine grain, wherein these constituents of the fine grain do not have to be ferromagnetic. The metal separator 16 can for example be formed as an eddy current separator.

The fine grain which is conveyed by the fine grain conveyor 11 is introduced onto the metal separator 16 from above. The fine grain conveyor 11 is lengthened in its conveying direction for this purpose. It comprises a downstream conveying portion 11*a* which extends up to and above an upstream end of the metal separator 16 and conveys the fine grain onto the metal separator 16. In the example embodiment, the fine grain conveyor 11 is lengthened in the conveying direction to form the conveying portion 11*a*, i.e., the same conveyance, for example a conveying belt, extends over the entire length of the fine grain conveyor 11 including the conveying portion 11*a*. In one modification, the downstream conveying portion 11*a* can be replaced with a separate fine grain conveyor which is arranged immediately downstream of the fine grain conveyor 11, preferably with one end below the fine grain conveyor 11.

In the third example embodiment, the metal separator 16 is again formed as a conveyor, preferably—as in the second example embodiment—a conveyor comprising a continuously rotating conveyance which can be formed for example as a conveying belt. If the metal separator 16 is an eddy current separator, as in the example embodiment, the electrically conductive constituents of the fine grain are correspondingly permeated by an eddy current and a magnetic force is induced which ensures that the electrically conductive constituents are catapulted at the downstream end of the metal separator 16 over a dividing wedge 26 arranged at that point, while the electrically non-conductive constituents or only weakly conductive constituents are conveyed onto an additional fine grain conveyor 17 in front of the dividing wedge 26, for example by simply falling onto the additional fine grain conveyor 17, whence they are for example conveyed back to the transverse conveyor 13 as shown and discharged by means of the transverse conveyor 13. The electrically conductive constituents of the fine grain which are catapulted over the dividing wedge 26 are caught and collected in a collecting container 27 or alternatively removed by means of an external metal remover.

If, as in the third example embodiment, the metal separator 16 is arranged where the feed means 3, 4 is arranged in the first and second example embodiments, this can necessitate a subsequent modification, as indicated for example in FIG. 8 by the modified feed means 3, 4. Aside from the features described, the sorting device of the third example embodiment corresponds to the sorting devices of the preceding two example embodiments.

Figure 9:
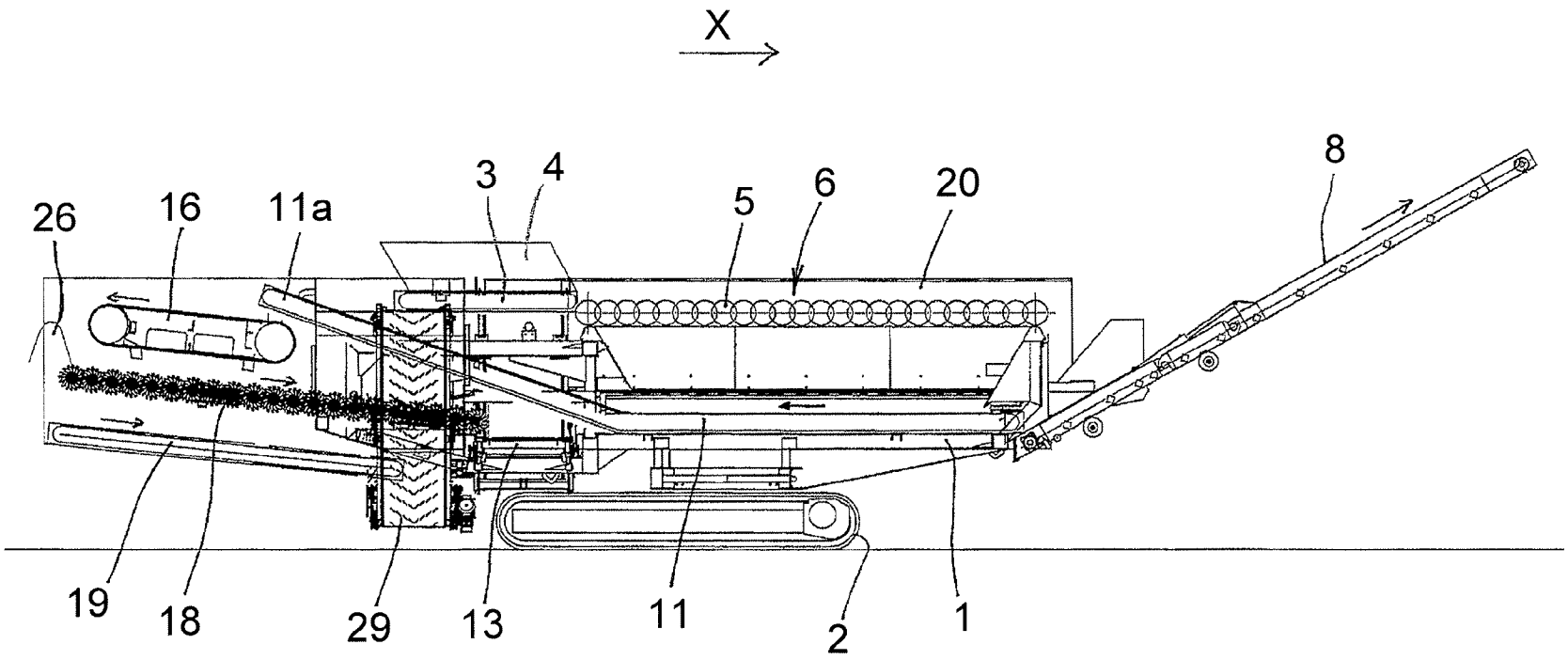
FIG. 9 a sorting device of a fourth example embodiment, in a longitudinal section.
Figure 10:
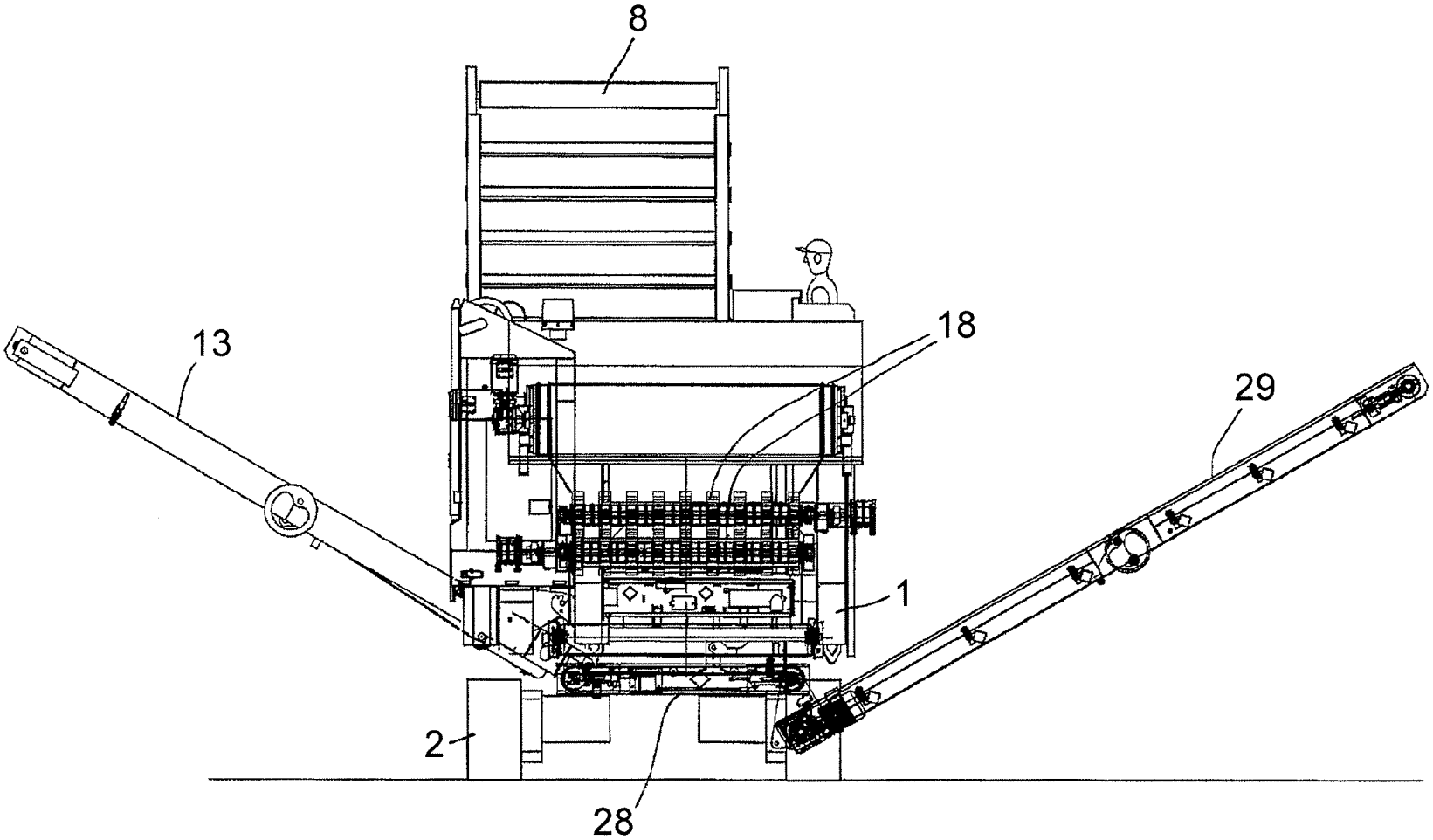
FIG. 10 the sorting device of the fourth example embodiment, in a cross-section.

FIGS. 9 and 10 show a longitudinal section and a cross-section of a sorting device of a fourth example embodiment. The sorting device is in its operational mode. The sorting device of the fourth example embodiment is a further development of the third example embodiment. The additional fine grain conveyor 17 of the third example embodiment (FIG. 8) has been replaced with an additional screen 18 and an ultrafine grain conveyor 19 which is associated with the additional screen 18. The fine grain conveyor 11 and the metal separator 16 can in particular be formed and arranged as in the third example embodiment.

The electrically non-conductive or not sufficiently conductive fine grain is conveyed by the metal separator 16 onto the additional screen 18 which extends to below the downstream end of the metal separator 16 for this purpose, such that said fine grain can fall off the metal separator 16 onto the additional screen 18. The additional screen 18 comprises a number of additional sorting rollers which are arranged alongside each other, at least substantially in parallel, and can be rotary-driven. The longitudinal direction of the additional sorting rollers points at least substantially parallel to the longitudinal direction Y of the sorting rollers 5; in modifications, however, it can also point transverse to the direction Y, i.e., orthogonally or obliquely with respect to the direction Y, in order for example to laterally discharge a residual fine grain, which can be conveyed on the additional screen 18, directly by means of the additional screen 18. Ultrafine grain contained in the fine grain provided by the metal separator 16 falls through the additional screen 18 onto the ultrafine grain conveyor 19 arranged below it, which is preferably formed as a conveyor belt. The ultrafine grain is conveyed by the ultrafine grain conveyor 19 to an additional transverse conveyor 29 which is in particular arranged in parallel alongside the transverse conveyor 13, as in the example embodiment, and can discharge the ultrafine grain either to the same side or, as in the example embodiment, to the other side. The residual fine grain which is conveyed on the additional screen 18 is conveyed back towards the fine grain conveyor 11 and conveyed onto and discharged by the transverse conveyor 13.

The sorting rollers of the additional screen 18 are formed as disc rollers, preferably star rollers, such as are described for example in EP 1 088 599 B1 which has already been mentioned. In modifications, the additional sorting rollers can instead likewise be formed as spiral and/or helical rollers. In yet other modifications, the additional screen 18 can also be formed as a vibration screen, for example a vibrationally driven mesh screen, wherein it is in particular advantageously arranged obliquely in such modifications in order to convey the residual fine grain, which remains on the additional screen, onwards by means of gravity and the vibration of the screen.

As can be seen in FIG. 10, a transverse intermediate conveyor 28 is associated with the transverse conveyor 29 which discharges the fine grain, wherein the transverse intermediate conveyor 28 conveys the ultrafine grain, which is delivered by the ultrafine grain conveyor 19, in the Y direction to the transverse conveyor 29. Instead of this division into the transverse conveyor 29 and transverse intermediate conveyor 28, these two transverse conveyors can also be replaced with one transverse conveyor comprising just one conveying belt or comparable rotating conveying means. This likewise applies with regard to the transverse conveyor 13, i.e., the transverse conveyor 13 can comprise one or more parts and be composed of a number of conveying belts or comparable rotating conveying means.

Both of the projecting transverse conveyors 13 and 29—in the other example embodiments, the transverse conveyor 13 only—can be moved back and forth between the operating position shown in FIG. 10 and a resting position in which they are retracted. The transverse conveyor 29 therefore comprises a multi-jointed discharge frame 9 comprising one or preferably more pivot axes or folding axes, such that at least a portion of the transverse conveyor 29 can be placed against the frame 1, at least substantially vertically, and another external portion can preferably be folded over the frame 1. Aside from the features described, the sorting device of the fourth example embodiment corresponds to the sorting device of the third example embodiment and otherwise to the sorting device of the first example embodiment.

The sorting device can advantageously comprise a traction drive of its own and in particular an energy supply of its own, as in the example embodiment, such that it can be autonomously transported and/or autonomously operated at the site of operations, i.e. does not require any external energy supply. In the example embodiment, it comprises an internal combustion engine as an integrated constituent part, as is preferred, and an electric generator 10 which is coupled to the internal combustion engine and can be seen in FIGS. 1, 2 and 4. A design in which the traction drive comprises one or more electric motors which is/are supplied with electrical energy by the generator 10 is advantageous. If the sorting device comprises one or more operating drives, such as for example the roller drive 7 and/or drives for extending and retracting the discharge means 8, 9, 13 and 29, then these operating motors can also advantageously be electric motors which are supplied with electrical energy by means of the generator 10. By contrast, actuating means such as for example an actuating means for the channelling means 20 can be driven fluidically and preferably hydraulically. The sorting device can therefore also comprise a fluid pump as an integrated constituent part, wherein the fluid pump is advantageously driven by means of an electric motor, and said pump drive is supplied with electrical energy by means of the generator 10.

REFERENCE SIGNS

1 frame
2 set of wheels
3 vibration means
4 conveyor
5 sorting rollers
6 roller screen
7 roller drive
8 conveyance
9 discharge frame
10 generator
11 fine grain conveyor
12 oversize grain conveyor
13 transverse conveyor
14 metal separator
15 metal remover, fine grain conveyor
16 metal separator
17 fine grain conveyor
18 additional screen, fine grain conveyor
19 ultrafine grain conveyor
20 channelling means, side wall
21 retaining structure
22 support
23 strip
24 magnetic means
25 channelling means
26 dividing wedge
27 collecting container
28 transverse conveyor
29 transverse conveyor
P pivot axis
X conveying direction
Y roller conveying direction, longitudinal of the rollers
Z vertical direction

The invention claimed is:

1. A sorting device for sorting a material mixture into fractions of different grain size, wherein the sorting device is adapted to be driven or transported by road or rail, comprising:

(a) a frame (1);

(b) sorting rollers (5) which are supported on the frame (1) and arranged alongside each other and adapted to be rotary-driven and which together form a roller screen (6) for sorting the material mixture into a fine grain which falls through the roller screen (6) and an oversize grain conveyable by the sorting rollers (5) in a roller conveying direction (Y) over a side edge of the roller screen (6);

(c) an oversize grain conveyor and collector (12), arranged below the sorting rollers (5), for removing or collecting the oversize grain conveyed over the side edge of the roller screen (6); and (d) a channelling means (20) which extends along the side edge and is inclined in an operating position towards the oversize grain conveyor and collector (12), at least in sections, between an upper region, which faces the side edge at a distance, and a lower region which is near the oversize grain conveyor and collector (12), in order to channel oversize grain, which is conveyed over the side edge of the roller screen (6) in the roller conveying direction (Y), downwards to the oversize grain conveyor and collector (12), wherein the channelling means (20) comprises a lower end which extends up to a lateral edge of or over the oversize grain conveyor or collector (12) in the operating position, and wherein the channelling means (20) is movable back and forth between the operating position and a resting position which is nearer the side edge of the roller screen (6), and comprises a flexible and/or freely protruding strip (23) at its lower end, wherein said strip laterally limits the oversize grain conveyor and collector (12) when the channelling means (20) is in the operating position, in order to prevent oversize grain from accumulating between the channelling means (20) and the oversize grain conveyor and collector (12).

2. The sorting device according to claim 1, wherein the channelling means (20) is movable back and forth between the operating position and a resting position which is nearer the side edge, in order to be able to decrease the overall dimensions of the sorting device as viewed in a plan view.

3. The sorting device according to claim 1, wherein the channelling means (20) forms an external side wall of the sorting device, which is pivotable out into the operating position and pivotable back towards the side edge of the roller screen (6) into a resting position.

4. The sorting device according to claim 1, wherein the channelling means (20) is pivotable back and forth, about a pivot axis (P) which is located lower than the roller screen (6) and extends at least substantially parallel to the side edge, between the operating position and a resting position which is nearer the side edge.

5. The sorting device according to claim 4, wherein the pivot axis (P) extends, as viewed in a plan view, onto the roller screen (6), within a strip which is parallel to the side edge of the roller screen (6) and overlaps the side edge and which has a width, as measured in the conveying direction (Y), of at most one meter (1 m) and protrudes outwards—in the conveying direction (Y)—beyond the side edge by at most 30 cm.

6. The sorting device according to claim 1, further comprising a retaining structure (21) which is arranged in a corner region of the roller screen (6) at the channelling means (20) and, in an operating position, prevents oversize grain from being moved transverse to the roller conveying direction (Y) and past the channelling means (20).

7. The sorting device according to claim 1, further comprising an additional conveying means (25) which is arranged below the roller screen (6) and extends over the oversize grain conveyor and collector (12) and is inclined, at least in sections, between an upper region near the side edge of the roller screen (6) and a lower region, in order to channel fine grain, which falls through the roller screen (6) above the oversize grain conveyor and collector (12), downwards.

8. The sorting device according to claim 7, further comprising a fine grain conveyor or collector (11), arranged below the sorting rollers (5), for removing or collecting a fine grain which falls through the roller screen (6), wherein the additional conveying means (25) is inclined towards the fine grain conveyor or collector (11) and extends up to or almost up to the fine grain conveyor or collector (11), in order to channel fine grain, which falls through the roller screen (6) above the oversize grain conveyor and collector (12), downwards to the fine grain conveyor or collector (11).

9. The sorting device according to claim 1, wherein the oversize grain conveyor or collector (12) is a conveyor, the sorting device comprising a fine grain conveyor (11), arranged below the sorting rollers (5), for removing a fine grain which falls through the roller screen (6), and a transverse conveyor (13), arranged downstream of either the fine grain conveyor (11) or the oversize grain conveyor (12), for removing either the fine grain deliverable by the fine grain conveyor (11) or the oversize grain deliverable by the oversize grain conveyor (12), wherein a conveying direction (Y) of the transverse conveyor (13) points transverse to a conveying direction (X) of either the fine grain conveyor (11) or the oversize grain conveyor (12) and/or at least substantially parallel to the roller conveying direction (Y).

10. The sorting device according to claim 1, further comprising a feed means (3, 4) for feeding the material mixture to the roller screen (6), wherein the feed means (3, 4) comprises a conveyor belt (4) and/or a vibration means (3) for loosening and vibrationally conveying the material mixture which is to be conveyed to the roller screen (6).

11. The sorting device according to claim 1, further comprising a fine grain conveyor (11), arranged below the sorting rollers (5), for removing a fine grain which falls through the roller screen (6), and one or more metal separators (14, 16) arranged downstream of the fine grain conveyor (11), the one or more metal separators comprising a magnetic separator (14) and/or an eddy current separator (16), for separating metal from the fine grain conveyed by the fine grain conveyor (11).

12. The sorting device according to claim 1, further comprising a fine grain conveyor (11), arranged below the sorting rollers (5), for removing a fine grain which falls through the roller screen (6); an additional screen (18), arranged downstream of the fine grain conveyor (11), for sorting the fine grain conveyable by the fine grain conveyor (11) to the additional screen (18) into ultrafine grain which falls through the additional screen (18) and residual fine grain which is conveyed on the additional screen; and an ultrafine grain conveyor or collector (19) for conveying or collecting the ultrafine grain arranged below the additional screen (18).

13. The sorting device according to claim 1, further comprising a discharge means (8, 9) which is arranged downstream of the roller screen (6), wherein the oversize grain which is conveyed over the side edge and by means of the oversize grain conveyor (12) and/or an oversize grain which is conveyed on the roller screen (6) transverse to the roller conveying direction (Y) is directed to the discharge means (8, 9) which serves to discharge the provided oversize grain from the sorting device.

14. The sorting device according to claim 1, further comprising a fine grain conveyor (11), arranged below the sorting rollers (5), for removing a fine grain which falls through the roller screen (6), wherein a conveying direction (X) of the fine grain conveyor (11) points at least substantially transverse to the roller conveying direction (Y), wherein the fine grain conveyor (11) and the oversize grain conveyor (12) are arranged alongside each other in a plan view and/or exhibit at least substantially parallel conveying directions (X) which are directed counter to each other.

15. The sorting device according to claim 1, wherein the sorting rollers (5) are spiral and/or helical rollers.

16. The sorting device according to claim 1, wherein the sorting rollers (5) are rotationally mounted on only one roller bearing side and each project freely in the longitudinal direction (Y) of the rollers, and the channelling means (20) extends along the side-faces of the sorting rollers (5) which face away from the roller bearing side in the longitudinal direction (Y) of the rollers.

17. The sorting device according to claim 1, further comprising one or more discharge means (8, 9, 13, 29) for discharging a grain fraction which can be sorted from the material mixture by means of the sorting device, wherein the respective discharge means is movable back and forth, between a transport position in which it is retracted onto or into the frame (1) and an operating position in which it is extended.

18. The sorting device according to claim 1, further comprising a mobile substation (2) with a wheel drive, a roller drive, a caterpillar drive or a chain drive, the mobile substation (2) carrying the frame (1).

19. The sorting device according to claim 1, wherein the sorting device comprises one or more drive motors and is adapted for self-driving.

20. The sorting device according to claim 1, further comprising: a generator and/or storage for electrical energy and one or more electric motors which is/are connected to the generator and/or storage in order to be supplied with electrical energy.

21. The sorting device according to claim 1, wherein the channelling means (20) is movable back and forth between the operating position and a resting position which is nearer the side edge, in order to decrease the overall dimensions of the sorting device as viewed in a plan view, and wherein when the channelling means (20) is in its resting position, the sorting device exhibits overall measured external dimensions (length, width, height) which are at most as large as the external dimensions of an ISO container according to ISO standard 668.

22. A sorting device for sorting a material mixture into fractions of different grain size, wherein the sorting device is adapted to be driven or transported by road or rail, comprising:

(a) a frame (1);

(b) sorting rollers (5) which are supported on the frame (1) and arranged alongside each other and adapted to be rotary-driven and which together form a roller screen (6) for sorting the material mixture into a fine grain which falls through the roller screen (6) and an oversize grain conveyable by the sorting rollers (5) in a roller conveying direction (Y) over a side edge of the roller screen (6);

(c) an oversize grain conveyor and collector (12), arranged below the sorting rollers (5), for removing or collecting the oversize grain conveyed over the side edge of the roller screen (6);

(d) a channelling means (20) which extends along the side edge and is inclined in an operating position towards the oversize grain conveyor and collector (12), at least in sections, between an upper region, which faces the side edge at a distance, and a lower region which is near the oversize grain conveyor and collector (12), in order to channel oversize grain, which is conveyed over the side edge of the roller screen (6) in the roller conveying direction (Y), downwards to the oversize grain conveyor and collector (12); and (e) an additional conveying means (25) which is arranged below the roller screen (6) and extends over the oversize grain conveyor and collector (12) and is inclined, at least in sections, between an upper region near the side edge of the roller screen (6) and a lower region, in order to channel fine grain, which falls through the roller screen (6) above the oversize grain conveyor and collector (12), downwards.

23. The sorting device according to claim 22, further comprising a fine grain conveyor or collector (11), arranged below the sorting rollers (5), for removing or collecting a fine grain which falls through the roller screen (6), wherein the additional conveying means (25) is inclined towards the fine grain conveyor or collector (11) and extends up to or almost up to the fine grain conveyor or collector (11), in order to channel fine grain, which falls through the roller screen (6) above the oversize grain conveyor and collector (12), downwards to the fine grain conveyor or collector (11).

24. A sorting device for sorting a material mixture into fractions of different grain size, wherein the sorting device is adapted to be driven or transported by road or rail, comprising:

(a) a frame (1);

(b) sorting rollers (5) which are supported on the frame (1) and arranged alongside each other and adapted to be rotary-driven and which together form a roller screen (6) for sorting the material mixture into a fine grain which falls through the roller screen (6) and an oversize grain conveyable by the sorting rollers (5) in a roller conveying direction (Y) over a side edge of the roller screen (6);

(c) an oversize grain conveyor and collector (12), arranged below the sorting rollers (5), for removing or collecting the oversize grain conveyed over the side edge of the roller screen (6);

(d) a channelling means (20) which extends along the side edge and is inclined in an operating position towards the oversize grain conveyor and collector (12), at least in sections, between an upper region, which faces the side edge at a distance, and a lower region which is near the oversize grain conveyor and collector (12), in order to channel oversize grain, which is conveyed over the side edge of the roller screen (6) in the roller conveying direction (Y), downwards to the oversize grain conveyor and collector (12), wherein the sorting rollers (5) are rotationally mounted on only one roller bearing side and each project freely in the longitudinal direction (Y) of the rollers, and the channelling means (20) extends along the side-faces of the sorting rollers (5) which face away from the roller bearing side in the longitudinal direction (Y) of the rollers.

* * * * *